US011518174B2

(12) United States Patent
Kurata et al.

(10) Patent No.: US 11,518,174 B2
(45) **Date of Patent: *Dec. 6, 2022**

(54) INKJET PRINTING APPARATUS

(71) Applicant: CANON KABUSHIKI KAISHA, Tokyo (JP)

(72) Inventors: Tetsuji Kurata, Yokohama (JP); Akira Kida, Yokohama (JP); Atsushi Kohnotoh, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/063,732

(22) Filed: Oct. 6, 2020

(65) Prior Publication Data

US 2021/0016575 A1 Jan. 21, 2021

Related U.S. Application Data

(63) Continuation of application No. 16/367,894, filed on Mar. 28, 2019, now Pat. No. 10,843,473.

(30) Foreign Application Priority Data

Mar. 29, 2018 (JP) ..... JP2018-065236

(51) Int. Cl.
*B41J 2/175* (2006.01)
*B41J 2/14* (2006.01)

(52) U.S. Cl.
CPC ..... *B41J 2/17523* (2013.01); *B41J 2/14* (2013.01); *B41J 2/1752* (2013.01)

(58) Field of Classification Search
CPC ..... B41J 2/17523
See application file for complete search history.

(56) References Cited

U.S. PATENT DOCUMENTS 5,751,322 A 5/1998 Miller et al.
6,012,806 A 1/2000 de Olazabal
(Continued)

FOREIGN PATENT DOCUMENTS

CN 102066117 A 5/2011
EP 2371560 A1 10/2011
(Continued)

OTHER PUBLICATIONS

Aug. 9, 2019 European Search Report in European Patent Appln. No. 19161660.6.

(Continued)

*Primary Examiner* — Sharon Polk
(74) *Attorney, Agent, or Firm* — Venable LLP

(57) ABSTRACT

An inkjet printing apparatus includes a print head ejecting ink, a tank reserving ink to be supplied to the print head and a joint unit being capable of connecting the print head and the tank to each other. The joint unit has a connecting portion for supplying ink to the print head and a shaft that is rotatable by a drive source so as to move in an axial direction. The connecting portion moves together with the shaft. The print head includes a head joint connectable to the connecting portion and an engaging portion engageable with one end of the shaft. The shaft is rotated to be engaged with the engaging portion so that the head joint and the connecting portion are connected to each other.

20 Claims, 18 Drawing Sheets

(56) References Cited

U.S. PATENT DOCUMENTS

| | | | | |
|---|---|---|---|---|
| 8,192,097 | B2 | 6/2012 | Ikeda et al. | |
| 10,843,473 | B2 * | 11/2020 | Kurata | B41J 2/14 |
| 2006/0170739 | A1 | 8/2006 | Koga et al. | |
| 2010/0149288 | A1 | 7/2010 | Hamasaki et al. | |
| 2011/0103870 | A1 | 5/2011 | Ikeda et al. | |
| 2015/0085004 | A1 * | 3/2015 | Yamaguchi | B41J 2/14 347/6 |
| 2015/0191020 | A1 | 7/2015 | Tominaga et al. | |
| 2017/0022381 | A1 | 1/2017 | Takamura et al. | |
| 2019/0299596 | A1 * | 10/2019 | Kohnotoh | B41J 2/17523 |
| 2019/0299632 | A1 * | 10/2019 | Shimoyama | B41J 2/1752 |

FOREIGN PATENT DOCUMENTS

| | | | | |
|---|---|---|---|---|
| EP | 3546226 | A1 * | 10/2019 | B41J 2/17523 |
| JP | H09-216376 | A | 8/1997 | |
| JP | H10-235892 | A | 9/1998 | |
| JP | 2006-205690 | A | 8/2006 | |
| JP | 2007-112130 | A | 5/2007 | |
| JP | 2009-274261 | A | 11/2009 | |
| JP | 2010-162871 | A | 7/2010 | |
| JP | 2010-173241 | A | 8/2010 | |
| JP | 2015-112842 | A | 6/2015 | |
| JP | 2015-128882 | A | 7/2015 | |
| JP | 2017-047547 | A | 3/2017 | |

OTHER PUBLICATIONS

Sep. 3, 2020 Chinese Official Action in Chinese Patent Appln. No. 201910249178.2.

Jul. 5, 2022 Office Action in Japanese Patent Application No. 2018-065236.

* cited by examiner

| POSITION NAME | SCREW SHAFT | | SENSOR | |
|---|---|---|---|---|
| | FIRST SCREW PORTION | SECOND SCREW PORTION | FIRST SENSOR | SECOND SENSOR |
| JOINT UPPER END | ENGAGED | RELEASE | Open | Open |
| JOINT UPPER SNS EDGE | ENGAGED | RELEASE | Edge | Open |
| JOINT HEAD TOUCH | ENGAGED | CONTACT | Close | Open |
| JOINT PLATE UP | ENGAGED | ENGAGED | Close | Open |
| JOINT PLATE RELEASE | CONTACT | ENGAGED | Close | Open |
| JOINT LOWER SNS EDGE | RELEASE | ENGAGED | Close | Edge |
| JOINT LOWER END | RELEASE | ENGAGED | Close | Close |
| JOINT OVERRUN | RELEASE | RELEASE | Open | Close |

FIG.15

INKJET PRINTING APPARATUS

This application is a continuation of application Ser. No. 16/367,894 filed Mar. 28, 2019.

BACKGROUND OF THE INVENTION

Field of the Invention

The present invention relates to an inkjet printing apparatus for ejecting ink so as to print an image.

Description of the Related Art

There are provided inkjet printing apparatuses, in which a user can replace print heads. Japanese Patent Laid-Open No. 2017-47547 discloses a configuration in which a print head is mounted on a printing apparatus, and in this state, a user connects a joint unit for supplying ink to the print head.

However, in the configuration disclosed in Japanese Patent Laid-Open No. 2017-47547, a user needs to manually connect the joint unit and the print head to each other while visually confirming guide pins disposed at the joint unit and guide holes formed at the print head. This places a heavy burden on the user.

SUMMARY OF THE INVENTION

The present invention has been accomplished to solve the above-described problem. Therefore, its object is to provide an inkjet printing apparatus capable of securely connecting a print head to a printing apparatus without placing a burden on a user.

According to a first aspect of the present invention, there is provided an inkjet printing apparatus comprising: a print head configured to eject ink; a tank configured to reserve ink to be supplied to the print head; and a joint unit configured to connect the print head and the tank to each other, wherein the joint unit includes a connecting portion for supplying ink to the print head and a shaft rotatable by a drive source so as to move in an axial direction, the connecting portion being movable together with the shaft, the print head includes a head joint connectable to the connecting portion and an engaging portion engageable with one end of the shaft, and the shaft is rotated to be engaged with the engaging portion so that the head joint and the connecting portion are connected to each other.

According to a second aspect of the present invention, there is provided an inkjet printing apparatus comprising: a print head configured to eject ink; a tank configured to reserve ink to be supplied to the print head; and a joint unit configured to connect the print head and the tank to each other, wherein the joint unit includes a connecting portion for supplying ink to the print head being movable by a drive source and a drive source to move the connecting portion, and the print head includes a head joint that is connectable to the connecting portion.

Further features of the present invention will become apparent from the following description of exemplary embodiments with reference to the attached drawings.

BRIEF DESCRIPTION OF THE DRAWINGS

FIG. 15 is a table illustrating the states of each member at corresponding positions of the joint unit;

DESCRIPTION OF THE EMBODIMENTS

Figure 1:
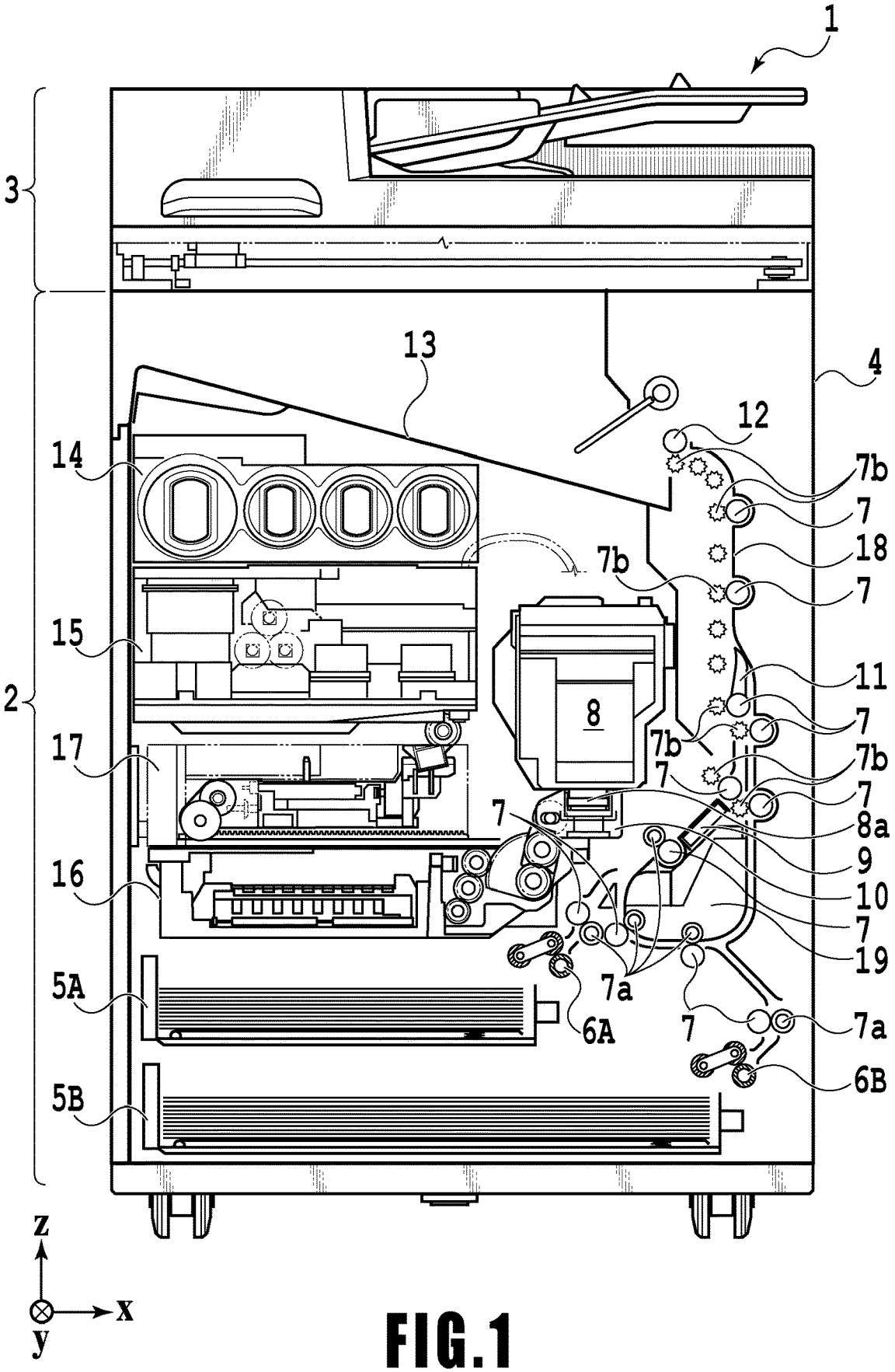
FIG. 1 is a diagram showing a printing apparatus in a standby state.

FIG. 1 is an internal configuration diagram of an inkjet printing apparatus 1 (hereinafter "printing apparatus 1") used in the present embodiment. In the drawings, an x-direction is a horizontal direction, a y-direction (a direction perpendicular to paper) is a direction in which ejection openings are arrayed in a head unit 80, described later, and a z-direction is a vertical direction opposite to the direction of gravity.

The printing apparatus 1 is a multifunction printer comprising a print unit 2 and a scanner unit 3. The printing apparatus 1 can use the print unit 2 and the scanner unit 3 separately or in synchronization to perform various processes related to print operation and scan operation. The scanner unit 3 comprises an automatic document feeder (ADF) and a flatbed scanner (FBS) and is capable of scanning a document automatically fed by the ADF as well as scanning a document placed on a document plate of the FBS by a user. The present embodiment is directed to the multifunction printer comprising both the print unit 2 and the scanner unit 3, but the scanner unit 3 may be omitted. FIG. 1 shows the printing apparatus 1 in a standby state in which neither print operation nor scan operation is performed.

In the print unit 2, a first cassette 5A and a second cassette 5B for housing print mediums (cut sheets) S are detachably provided at the bottom of a casing 4 in the vertical direction. Relatively small print mediums of up to an A4 size are stacked and housed in the first cassette 5A and relatively large print mediums of up to an A3 size are stacked and housed in the second cassette 5B. A first feeding unit 6A for feeding the housed print mediums one by one is provided near the first cassette 5A. Similarly, a second feeding unit 6B is provided near the second cassette 5B. In print operation, a print medium S is selectively fed from either one of the cassettes.

Conveying rollers 7, a discharging roller 12, pinch rollers 7*a*, spurs 7*b*, a guide 18, an inner guide 19, and a flapper 11 are conveying mechanisms for guiding a print medium S in a predetermined direction. The conveying rollers 7 are drive rollers located upstream and downstream of a head unit 8 and driven by a conveying motor (not shown). The pinch rollers 7*a* are follower rollers that are turned while nipping a print medium S together with the conveying rollers 7. The discharging roller 12 is a drive roller located downstream of the conveying rollers 7 and driven by the conveying motor (not shown). The spurs 7*b* nip and convey a print medium S together with the conveying rollers 7 and discharging roller 12 located downstream of the head unit 8.

The guide 18 is provided in a conveying path of a print medium S to guide the print medium S in a predetermined direction. The inner guide 19 is a member extending in the y-direction. The inner guide 19 has a curved side surface and guides a print medium S along the side surface. The flapper 11 is a member for changing a direction in which a print medium S is conveyed in duplex print operation. A discharging tray 13 is a tray for stacking and housing print mediums S that were subjected to print operation and discharged by the discharging roller 12.

The head unit 8 of the present embodiment is configured by disposing a print head 80 at a head holder 20, described later. The print head 80 is a full line type color inkjet print head. In the head unit 8, a plurality of ejection openings configured to eject ink based on print data are arrayed in the y-direction in FIG. 1 so as to correspond to the width of a print medium S. When the head unit 8 is in a standby position, an ejection opening surface 8*a* of the head unit 8 (the print head 80) is oriented vertically downward and capped with a cap unit 10, as shown in FIG. 1. In print operation, the orientation of the head unit 8 is changed by a print controller 202, described later, such that the ejection opening surface 8*a* faces a platen 9. The platen 9 includes a flat plate extending in the y-direction and supports a print medium S being subjected to print operation by the head unit 8 from the back side. The movement of the head unit 8 from the standby position to a printing position will be described later in detail.

An ink tank unit 14 separately stores ink of four colors to be supplied to the head unit 8. An ink supply unit 15 is provided in the midstream of a flow path connecting the ink tank unit 14 to the head unit 8 to adjust the pressure and flow rate of ink in the print head 80 within a suitable range. The present embodiment adopts a circulation type ink supply system, where the ink supply unit 15 adjusts the pressure of ink to be supplied to the print head 80 and the flow rate of ink collected from the print head 80 within a suitable range.

A maintenance unit 16 comprises the cap unit 10 and a wiping unit 17 and activates them at predetermined timings to perform maintenance operation for the print head 80.

Figure 2:
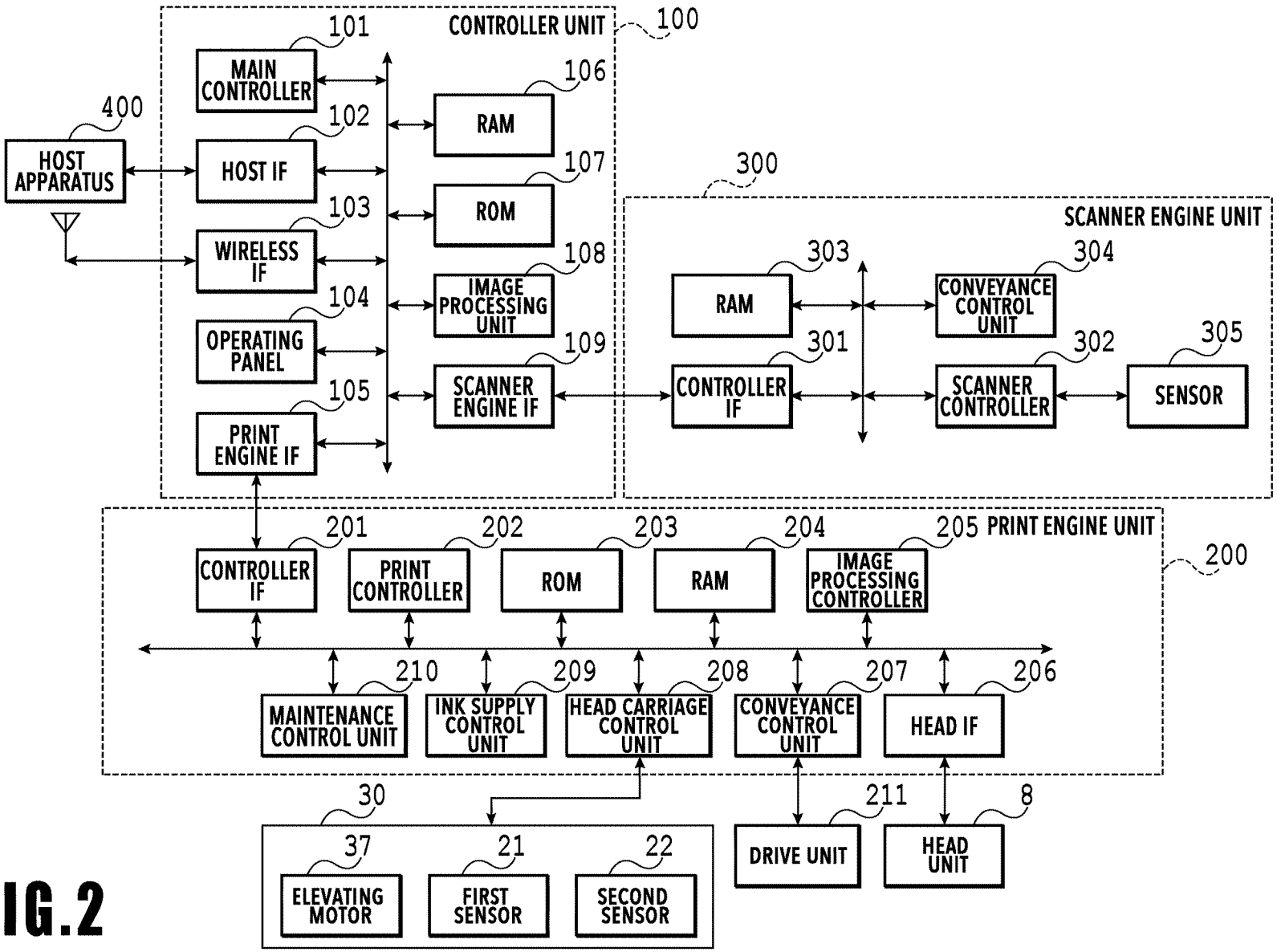
FIG. 2 is a control configuration diagram of the printing apparatus.

FIG. 2 is a block diagram showing a control configuration in the printing apparatus 1. The control configuration mainly includes a print engine unit 200 that exercises control over the print unit 2, a scanner engine unit 300 that exercises control over the scanner unit 3, and a controller unit 100 that exercises control over the entire printing apparatus 1. A print controller 202 controls various mechanisms of the print engine unit 200 under instructions from a main controller 101 of the controller unit 100. Various mechanisms of the scanner engine unit 300 are controlled by the main controller 101 of the controller unit 100. The control configuration will be described below in detail.

In the controller unit 100, the main controller 101 including a CPU controls the entire printing apparatus 1 using a RAM 106 as a work area in accordance with various parameters and programs stored in a ROM 107. For example, when a print job is input from a host apparatus 400 via a host I/F 102 or a wireless I/F 103, an image processing unit 108 executes predetermined image processing for received image data under instructions from the main controller 101. The main controller 101 transmits the image data subjected to the image processing to the print engine unit 200 via a print engine I/F 105.

The printing apparatus 1 may acquire image data from the host apparatus 400 via a wireless or wired communication or acquire image data from an external storage unit (such as a USB memory) connected to the printing apparatus 1. A communication system used for the wireless or wired communication is not limited. For example, as a communication system for the wireless communication, Wi-Fi (Wireless Fidelity; registered trademark) and Bluetooth (registered trademark) can be used. As a communication system for the wired communication, a USB (Universal Serial Bus) and the like can be used. For example, when a scan command is input from the host apparatus 400, the main controller 101 transmits the command to the scanner unit 3 via a scanner engine I/F 109.

An operating panel 104 is a mechanism to allow a user to do input and output for the printing apparatus 1. A user can give an instruction to perform operation such as copying and scanning, set a print mode, and recognize information about the printing apparatus 1 via the operating panel 104.

In the print engine unit 200, the print controller 202 including a CPU controls various mechanisms of the print unit 2 using a RAM 204 as a work area in accordance with various parameters and programs stored in a ROM 203. When various commands and image data are received via a controller I/F 201, the print controller 202 temporarily stores them in the RAM 204. The print controller 202 allows an image processing controller 205 to convert the stored image data into print data such that the head unit 8 can use it for print operation. After the generation of the print data, the print controller 202 allows the head unit 8 to perform print operation based on the print data via a head I/F 206. At this time, the print controller 202 conveys a print medium S by driving the feeding units 6A and 6B, conveying rollers 7, discharging roller 12, and flapper 11 shown in FIG. 1 via a conveyance control unit 207. The head unit 8 performs print operation in synchronization with the conveyance operation of the print medium S under instructions from the print controller 202, thereby performing printing.

A head carriage control unit 208 changes the orientation and position of the head unit 8 in accordance with an operating state of the printing apparatus 1 such as a maintenance state or a printing state. The head carriage control unit 208 also controls the connection between the head unit 8 and a joint unit 30 (not shown in FIG. 2) for connecting ink to the head unit 8. More specifically, the head carriage control unit 208 includes an elevating motor 37 for elevating the joint unit 30 and a first sensor 21 and a second sensor 22 which are adapted to confirm the vertical position of the joint unit 30. Based on the detection results of these sensors, the elevating motor 37 is driven. The connection control between the head unit 8 and the joint unit 30 will be particularly explained later.

An ink supply control unit 209 controls the ink supply unit 15 such that the pressure of ink supplied to the head unit 8 is within a suitable range. A maintenance control unit 210 controls the operation of the cap unit 10 and wiping unit 17 in the maintenance unit 16 when performing maintenance operation for the head unit 8.

In the scanner engine unit 300, the main controller 101 controls hardware resources of a scanner controller 302 using the RAM 106 as a work area in accordance with various parameters and programs stored in the ROM 107, thereby controlling various mechanisms of the scanner unit 3. For example, the main controller 101 controls hardware resources in the scanner controller 302 via a controller I/F 301 to cause a conveyance control unit 304 to convey a document placed on the ADF by a user and cause a sensor 305 to scan the document. The scanner controller 302 stores scanned image data in a RAM 303. The print controller 202 can convert the image data acquired, as described above, into print data to enable the head unit 8 to perform print operation based on the image data scanned by the scanner controller 302.

Figure 3:
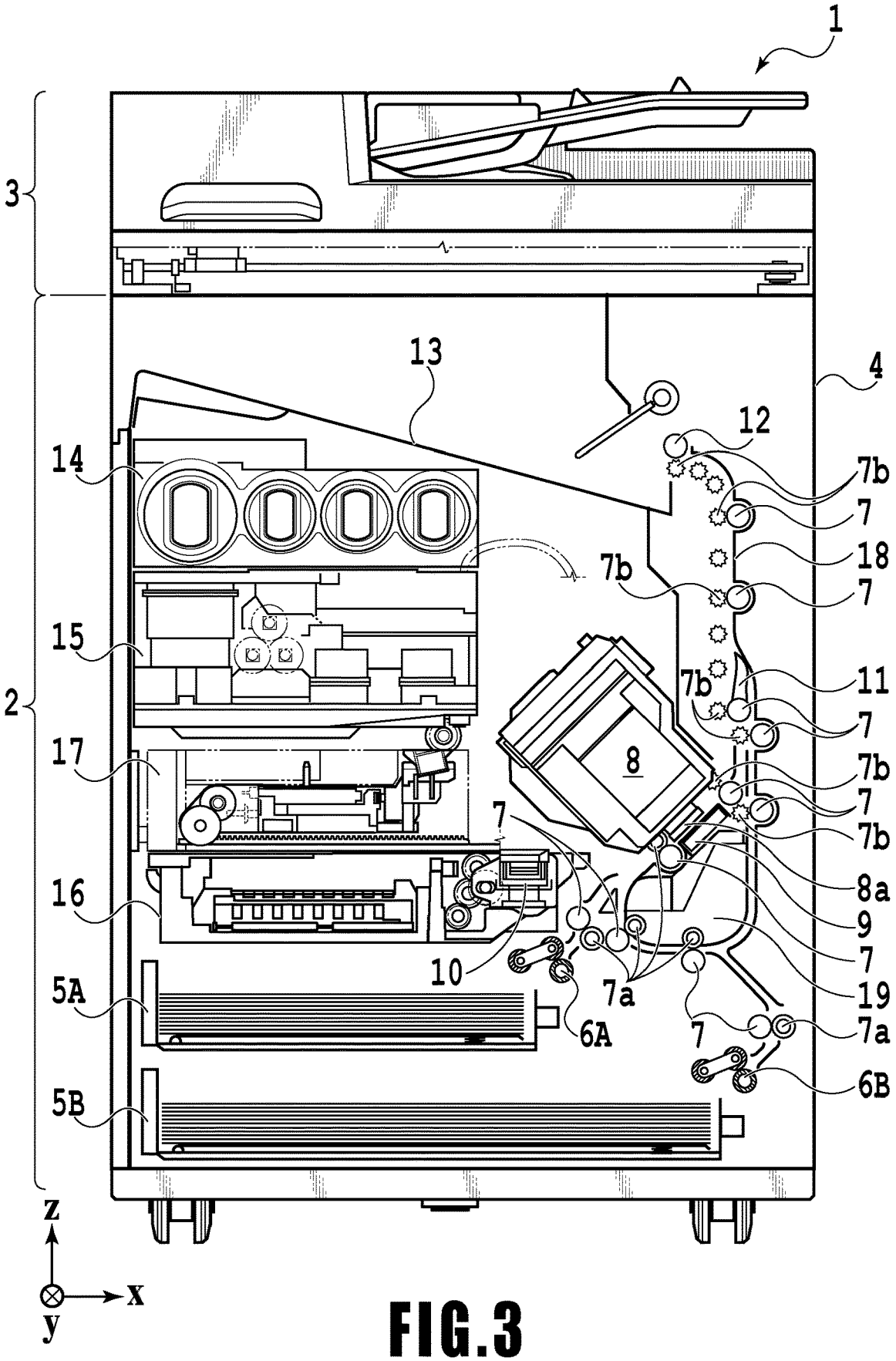
FIG. 3 is a diagram showing the printing apparatus in a printing state.

FIG. 3 shows the printing apparatus 1 in a printing state. As compared with the standby state shown in FIG. 1, the cap unit 10 is separated from the ejection opening surface 8*a* of the head unit 8 and the ejection opening surface 8*a* faces the platen 9. In the present embodiment, the plane of the platen 9 is inclined about 45° with respect to the horizontal plane. The ejection opening surface 8*a* of the head unit 8 in a printing position is also inclined about 45° with respect to the horizontal plane so as to keep a constant distance from the platen 9.

In the case of moving the head unit 8 from the standby position shown in FIG. 1 to the printing position shown in FIG. 3, the print controller 202 uses the maintenance control unit 210 to move the cap unit 10 down to an evacuation position shown in FIG. 3, thereby separating a cap member from the ejection opening surface 8*a* of the head unit 8. The print controller 202 then uses the head carriage control unit 208 to turn the head unit 8 45° while adjusting the vertical height of the head unit 8 such that the ejection opening surface 8*a* faces the platen 9. After the completion of print operation, the print controller 202 reverses the above procedure to move the head unit 8 from the printing position to the standby position.

Next, a conveying path of a print medium S in the print unit 2 will be described. When a print command is input, the print controller 202 first uses the maintenance control unit 210 and the head carriage control unit 208 to move the head unit 8 to the printing position shown in FIG. 3. The print controller 202 then uses the conveyance control unit 207 to drive either the first feeding unit 6A or the second feeding unit 6B in accordance with the print command and feed a print medium S.

Figure 4C:
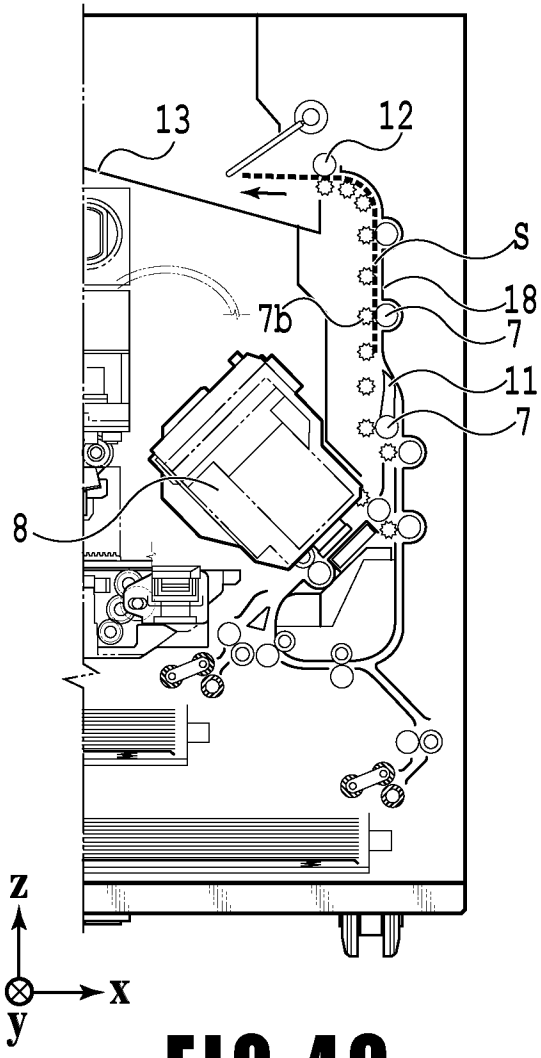
FIGS. 4A to 4C are conveying path diagrams of a print medium fed from a first cassette.
Figure 4B:
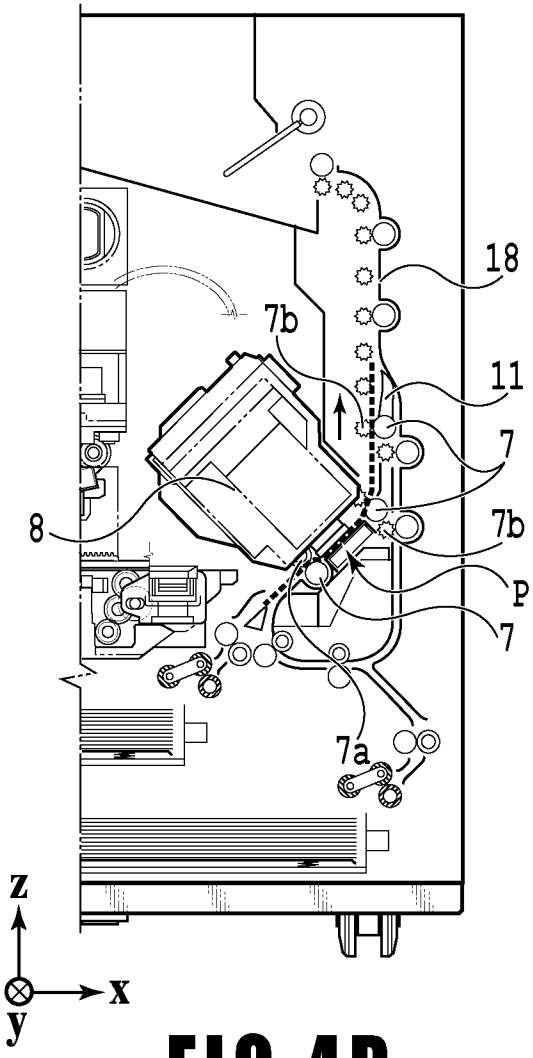
Figure 4A:
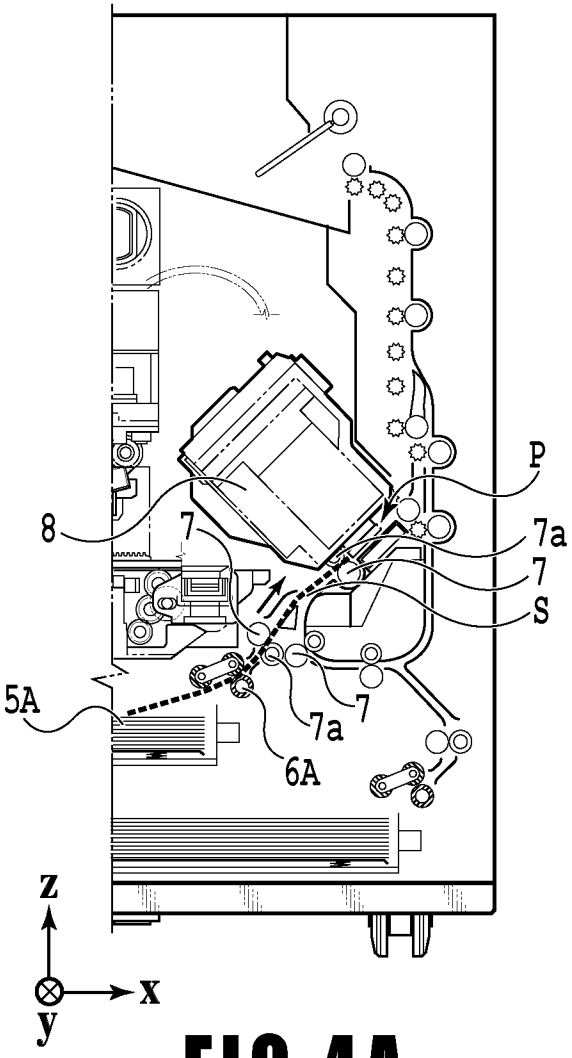

FIGS. 4A to 4C are diagrams showing a conveying path in the case of feeding an A4 size print medium S from the first cassette 5A. A print medium S at the top of a stack of print mediums in the first cassette 5A is separated from the rest of the stack by the first feeding unit 6A and conveyed toward a print area P between the platen 9 and the head unit 8 while being nipped between the conveying rollers 7 and the pinch rollers 7*a*. FIG. 4A shows a conveying state where the front end of the print medium S is about to reach the print area P. The direction of movement of the print medium S is changed from the horizontal direction (x-direction) to a direction inclined about 45° with respect to the horizontal direction while being fed by the first feeding unit 6A to reach the print area P.

In the print area P, a plurality of ejection openings provided in the print head 80 eject ink toward the print medium S. In an area where ink is applied to the print medium S, the back side of the print medium S is supported by the platen 9 so as to keep a constant distance between the ejection opening surface 8*a* and the print medium S. After ink is applied to the print medium S, the conveying rollers 7 and the spurs 7*b* guide the print medium S such that the print medium S passes on the left of the flapper 11 with its tip inclined to the right and is conveyed along the guide 18 in the vertically upward direction of the printing apparatus 1. FIG. 4B shows a state where the front end of the print medium S has passed through the print area P and the print medium S is being conveyed vertically upward. The conveying rollers 7 and the spurs 7*b* change the direction of movement of the print medium S from the direction inclined about 45° with respect to the horizontal direction in the print area P to the vertically upward direction.

After being conveyed vertically upward, the print medium S is discharged into the discharging tray 13 by the discharging roller 12 and the spurs 7*b*. FIG. 4C shows a state where the front end of the print medium S has passed through the discharging roller 12 and the print medium S is being discharged into the discharging tray 13. The discharged print medium S is held in the discharging tray 13 with the side on which an image was printed by the head unit 8 down.

Figure 5C:
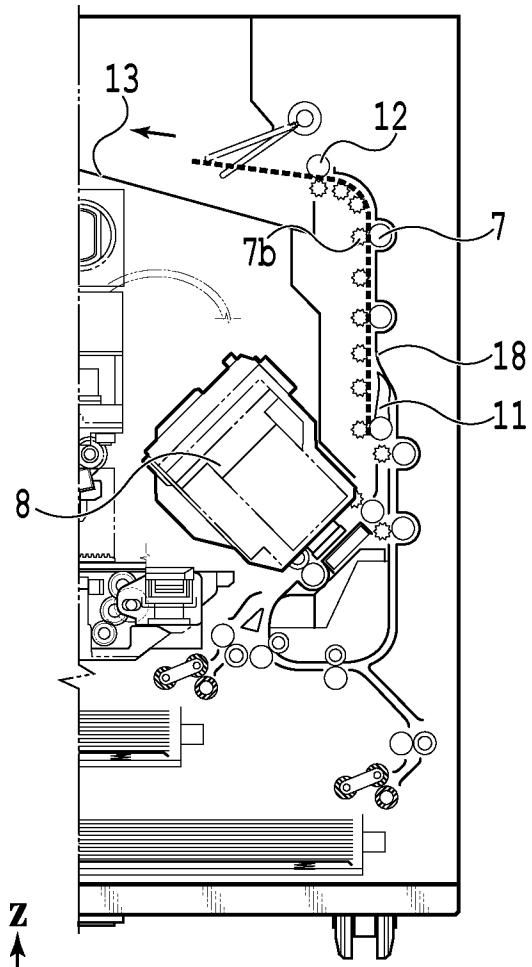
FIGS. 5A to 5C are conveying path diagrams of a print medium fed from a second cassette.
Figure 5B:
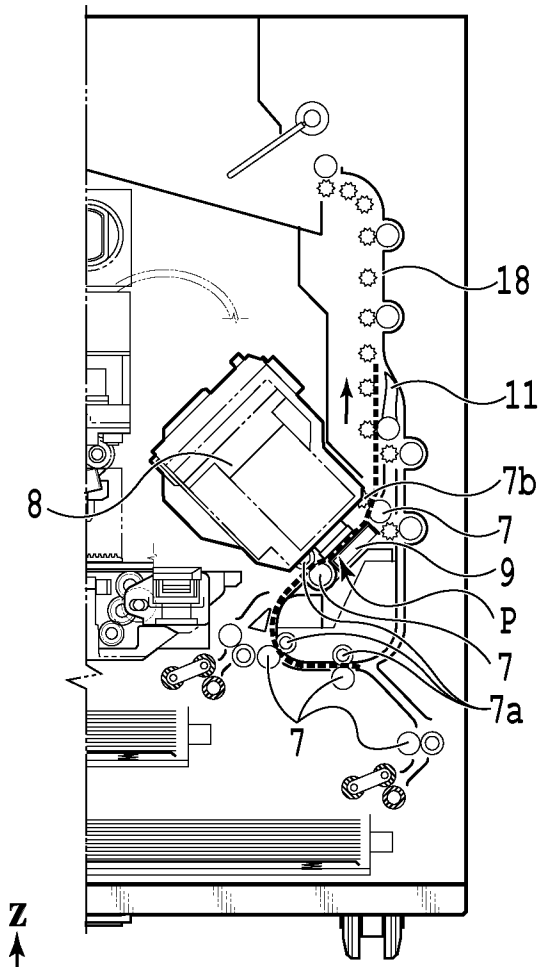
Figure 5A:
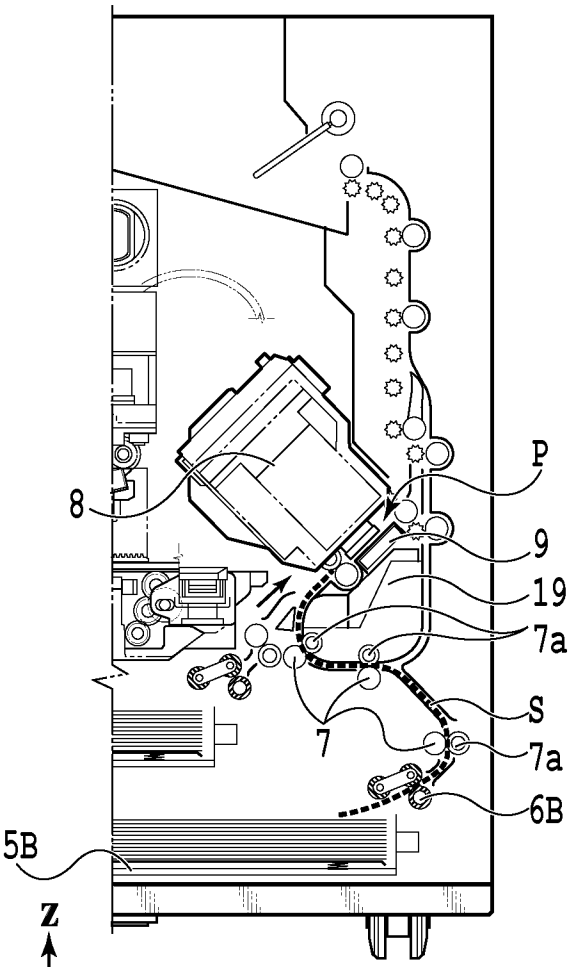

FIGS. 5A to 5C are diagrams showing a conveying path in the case of feeding an A3 size print medium S from the second cassette 5B. A print medium S at the top of a stack of print medium in the second cassette 5B is separated from the rest of the stack by the second feeding unit 6B and conveyed toward the print area P between the platen 9 and the head unit 8 while being nipped between the conveying rollers 7 and the pinch rollers 7*a*.

FIG. 5A shows a conveying state where the front end of the print medium S is about to reach the print area P. In a part of the conveying path, through which the print medium S is fed by the second feeding unit 6B toward the print area P, the plurality of conveying rollers 7, the plurality of pinch rollers 7*a*, and the inner guide 19 are provided such that the print medium S is conveyed to the platen 9 while being bent into an S-shape.

The rest of the conveying path is the same as that in the case of the A4 size print medium S shown in FIGS. 4B and 4C. FIG. 5B shows a state where the front end of the print medium S has passed through the print area P and the print medium S is being conveyed vertically upward. FIG. 5C shows a state where the front end of the print medium S has passed through the discharging roller 12 and the print medium S is being discharged into the discharging tray 13.

FIGS. 6A to 6D show a conveying path in the case of performing print operation (duplex printing) for the back side (second side) of an A4 size print medium S. In the case of duplex printing, print operation is first performed for the first side (front side) and then performed for the second side (back side). A conveying procedure during print operation for the first side is the same as that shown in FIGS. 4A to 4C and therefore description will be omitted. A conveying procedure subsequent to FIG. 4C will be described below.

Figure 6D:
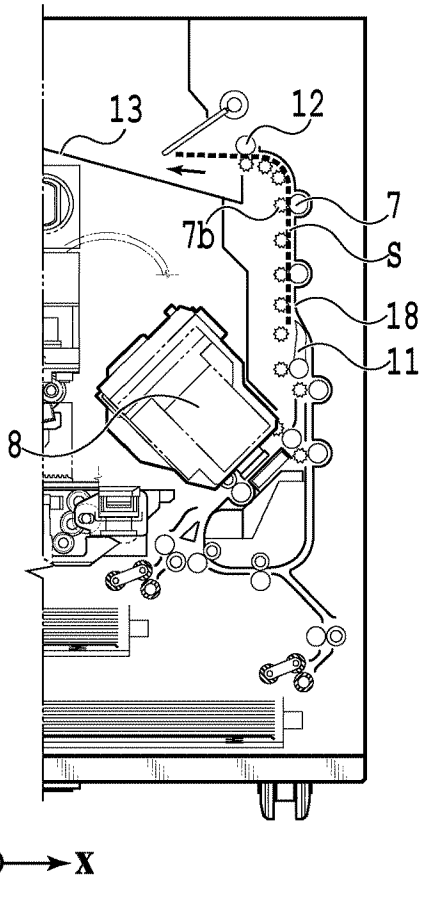
FIGS. 6A to 6D are conveying path diagrams in the case of performing print operation for the back side of a print medium.
Figure 6C:
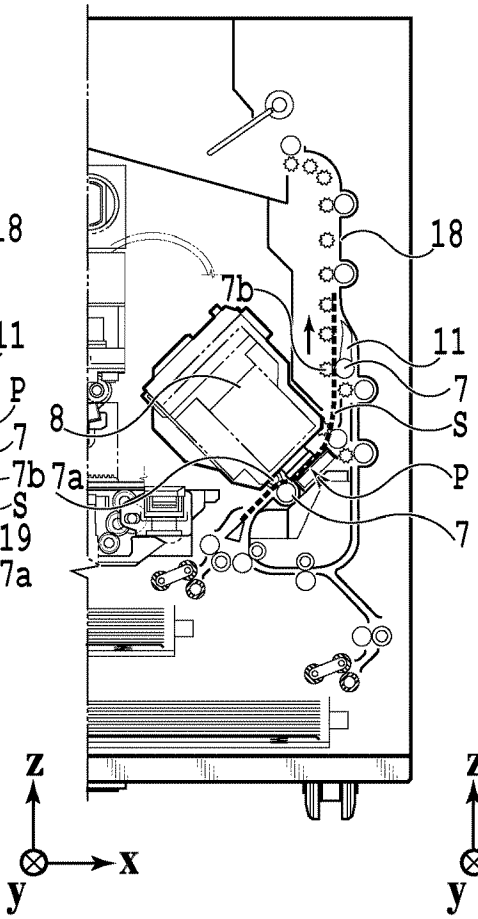
Figure 6B:
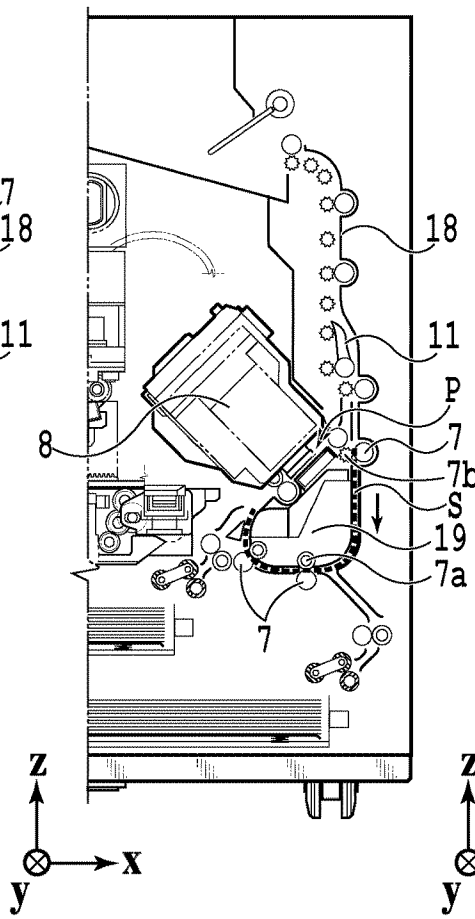
Figure 6A:
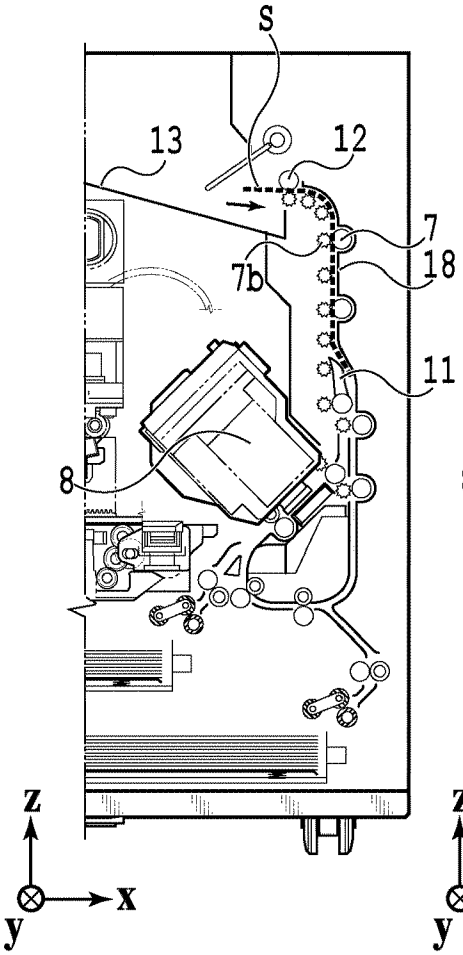

After the head unit 8 finishes print operation for the first side and the back end of the print medium S passes by the flapper 11, the print controller 202 turns the conveying rollers 7 backward to convey the print medium S into the printing apparatus 1. At this time, since the flapper 11 is controlled by an actuator (not shown) such that the tip of the flapper 11 is inclined to the left, the front end of the print medium S (corresponding to the back end during the print operation for the first side) passes on the right of the flapper 11 and is conveyed vertically downward. FIG. 6A shows a state where the front end of the print medium S (corresponding to the back end during the print operation for the first side) is passing on the right of the flapper 11.

Then, the print medium S is conveyed along the curved outer surface of the inner guide 19 and then conveyed again to the print area P between the head unit 8 and the platen 9. At this time, the second side of the print medium S faces the ejection opening surface 8*a* of the head unit 8. FIG. 6B shows a conveying state where the front end of the print medium S is about to reach the print area P for print operation for the second side.

The rest of the conveying path is the same as that in the case of the print operation for the first side shown in FIGS. 4B and 4C. FIG. 6C shows a state where the front end of the print medium S has passed through the print area P and the print medium S is being conveyed vertically upward. At this time, the flapper 11 is controlled by the actuator (not shown) such that the tip of the flapper 11 is inclined to the right. FIG. 6D shows a state where the front end of the print medium S has passed through the discharging roller 12 and the print medium S is being discharged into the discharging tray 13.

Next, maintenance operation for the head unit 8 will be described. As described with reference to FIG. 1, the maintenance unit 16 of the present embodiment comprises the cap unit 10 and a wiping unit 17 and activates them at predetermined timings to perform maintenance operation.

Figure 7:
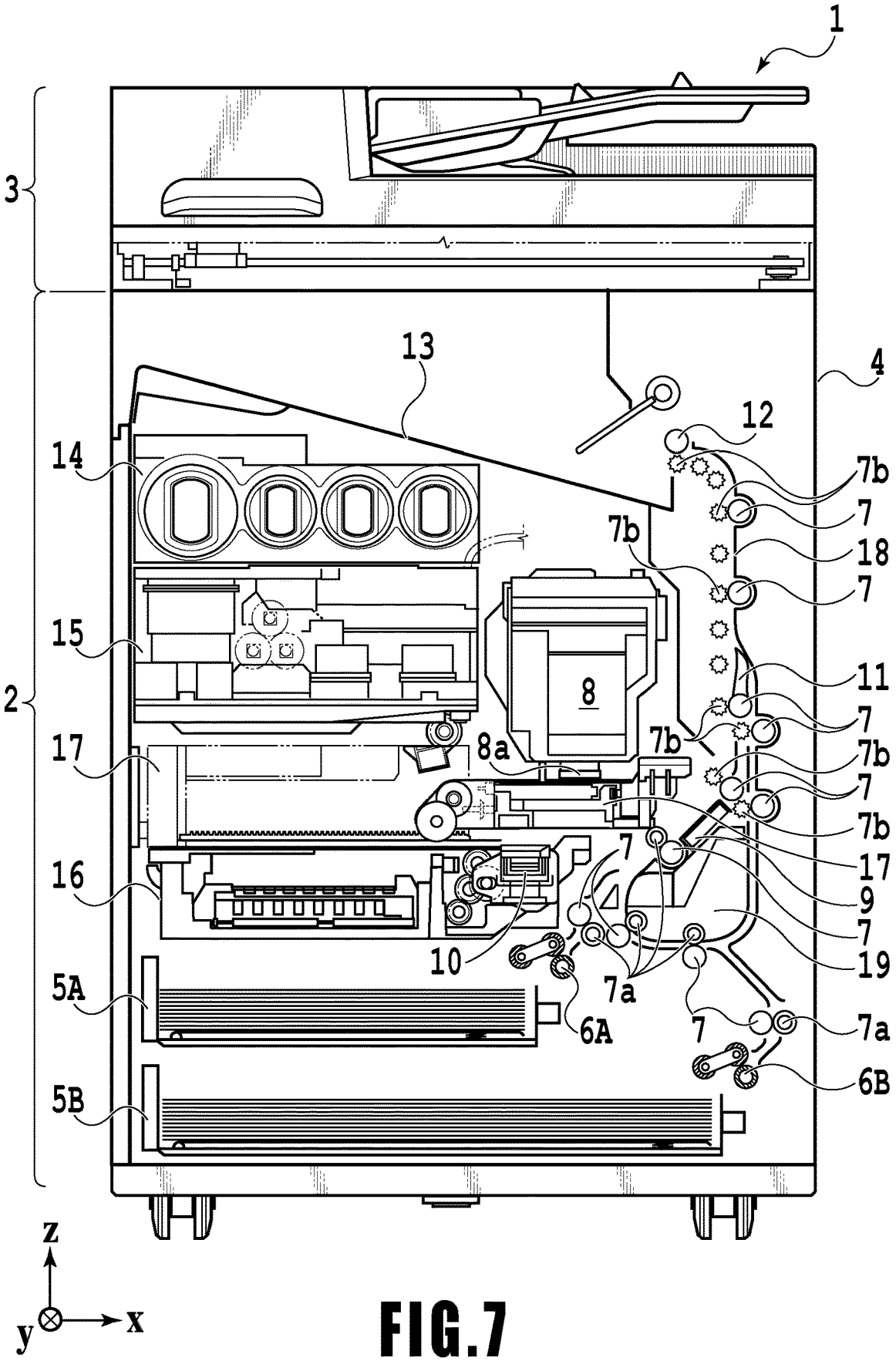
FIG. 7 is a diagram showing the printing apparatus in a maintenance state.

FIG. 7 is a diagram showing the printing apparatus 1 in a maintenance state. In the case of moving the head unit 8 from the standby position shown in FIG. 1 to a maintenance position shown in FIG. 7, the print controller 202 moves the head unit 8 vertically upward and moves the cap unit 10 vertically downward. The print controller 202 then moves the wiping unit 17 from the evacuation position to the right in FIG. 7. After that, the print controller 202 moves the head unit 8 vertically downward to the maintenance position where maintenance operation can be performed.

On the other hand, in the case of moving the head unit 8 from the printing position shown in FIG. 3 to the maintenance position shown in FIG. 7, the print controller 202 moves the head unit 8 vertically upward while turning it 45°. The print controller 202 then moves the wiping unit 17 from the evacuation position to the right. Following that, the print controller 202 moves the head unit 8 vertically downward to the maintenance position where maintenance operation can be performed by the maintenance unit 16.

Next, a description will be given of a configuration for mounting the print head 80 on the printing apparatus 1. When the print head 80 is mounted on or demounted from the printing apparatus 1, the head unit 8 is moved to a position higher by about several centimeters than the maintenance position shown in FIG. 7.

Figure 8:
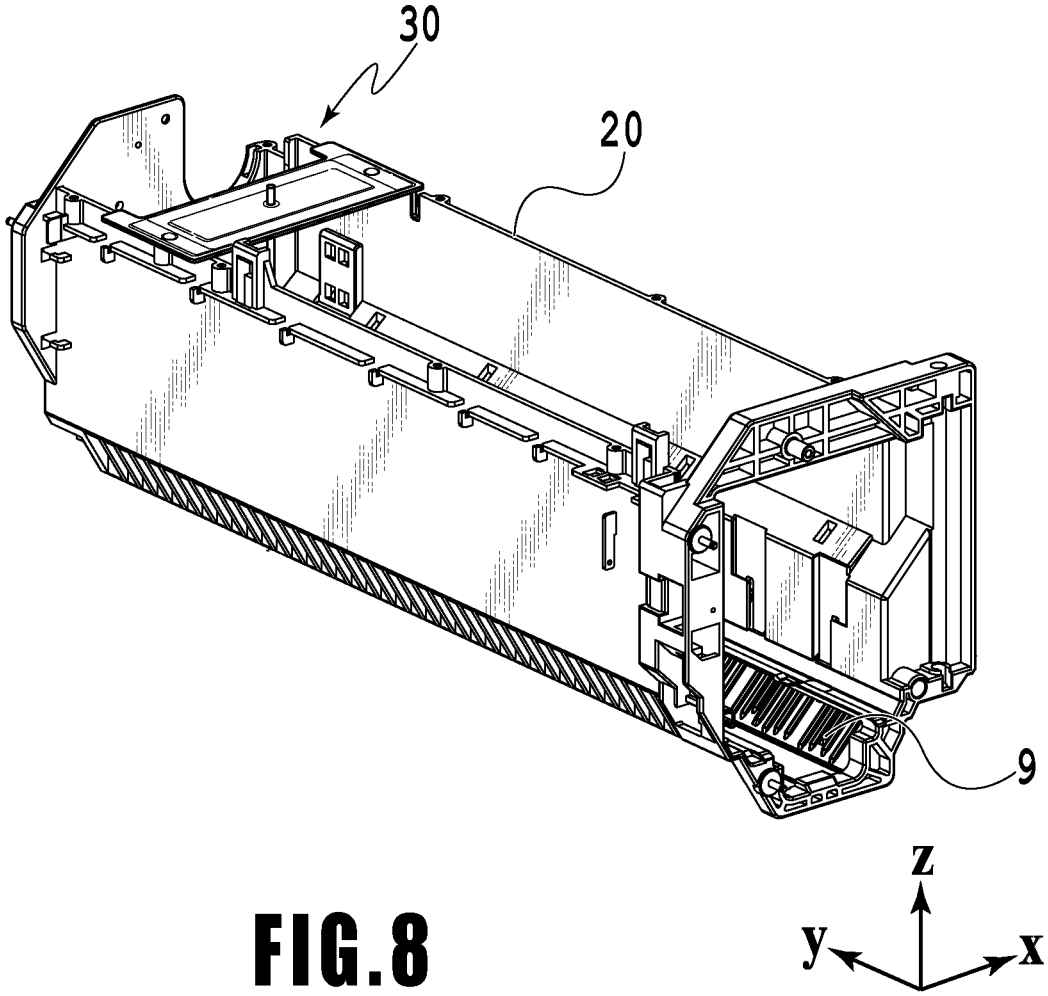
FIG. 8 is a view showing a head holder.

FIG. 8 is a view showing the head holder 20 provided in the printing apparatus 1, for mounting the print head 80 thereon. The head holder 20 is a hollow casing extending in the y direction. The print head 80 is inserted sideways into the head holder 20 in the +y direction, to be thus mounted in an apparatus body. On the back side of the head holder 20 are disposed a connected portion, not shown in FIG. 8, for making electric connection to the print head 80 to be inserted and a joint unit 30 for making fluid connection to the print head 80.

Figure 9A:
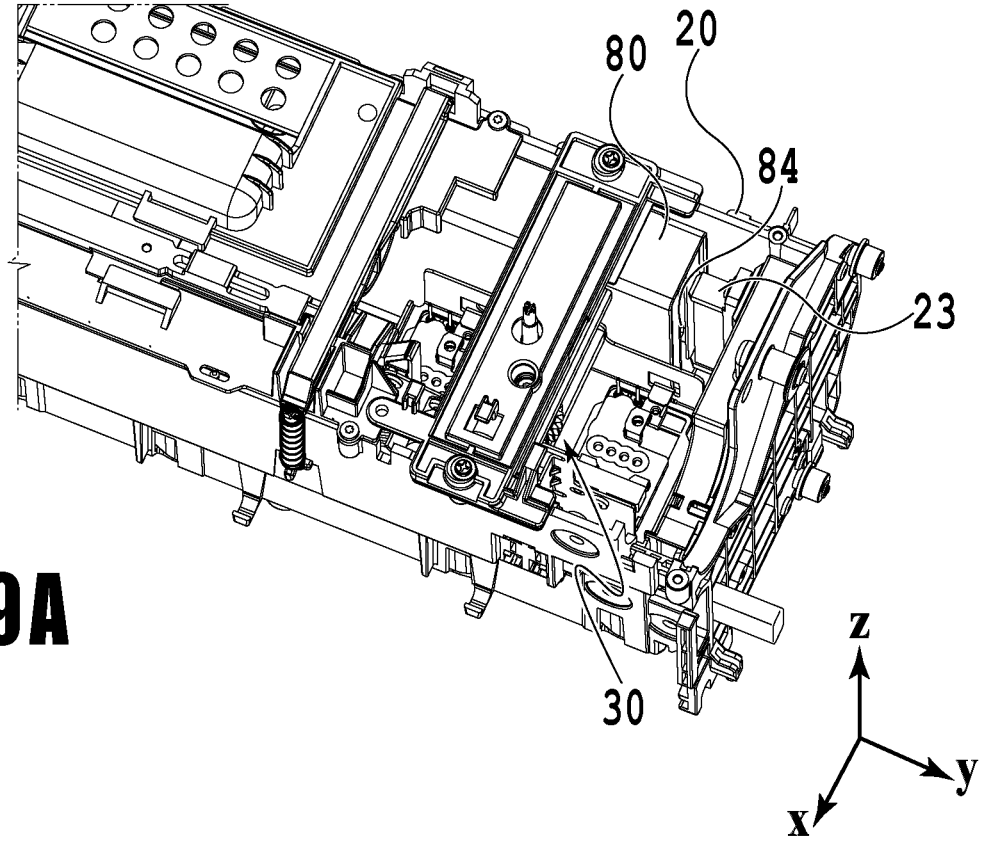
FIGS. 9A and 9B are views showing a print head which is to be inserted.
Figure 9B:
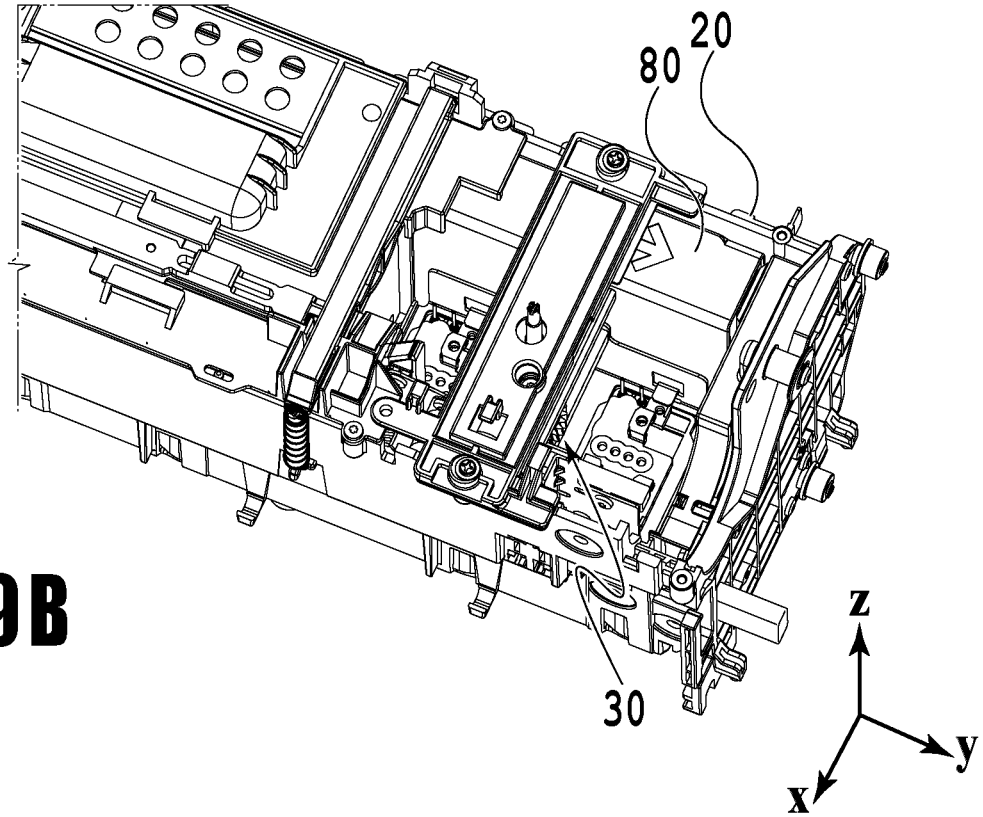

FIGS. 9A and 9B are views showing the print head 80 which is to be inserted into the head holder 20. When a new print head 80 is mounted on the printing apparatus 1, a user inserts the print head 80 into an empty head holder 20 in the +y direction. An electric connected portion 84 on the head side is disposed at the tip in an insertion direction of the print head 80, and furthermore, an electric connected portion 23 on the holder side is disposed inside of the head holder 20 and at a position opposite to the electric connected portion 84 on the head side. As a consequence, when the user inserts the print head 80 into the head holder 20, and then, slides it in the y direction, these electric connected portions are joined to each other, so that the print head 80 is electrically connected to the printing apparatus 1. Meanwhile, the joint unit 30 for connecting the print head 80 and the ink supplying unit 15 to each other retards, in the +z direction, from a region in which the print head 80 slides. Therefore, the joint unit 30 never prevents the print head 80 from sliding.

Figure 10A:
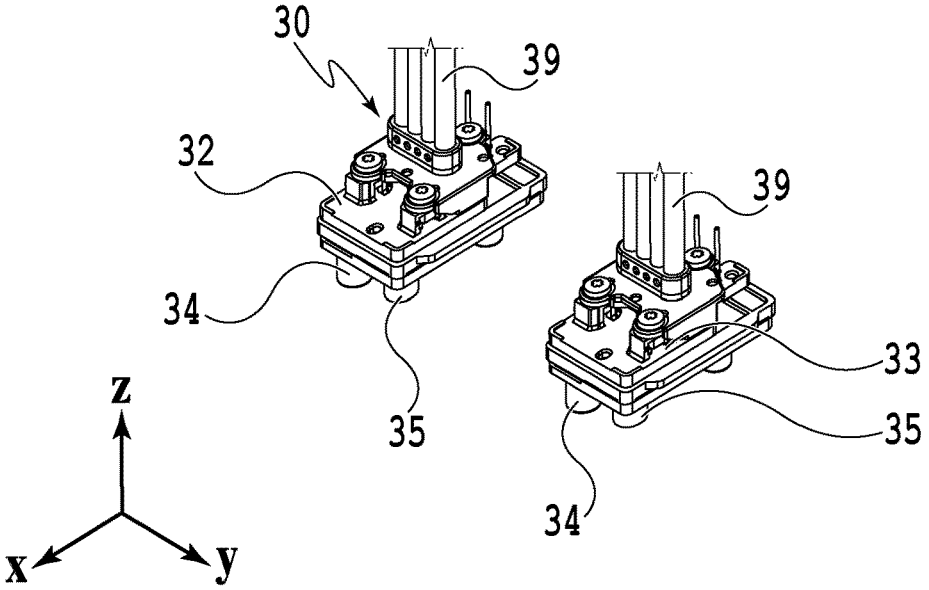
FIGS. 10A and 10B are views showing a connected portion between the print head and a joint unit.
Figure 10B:
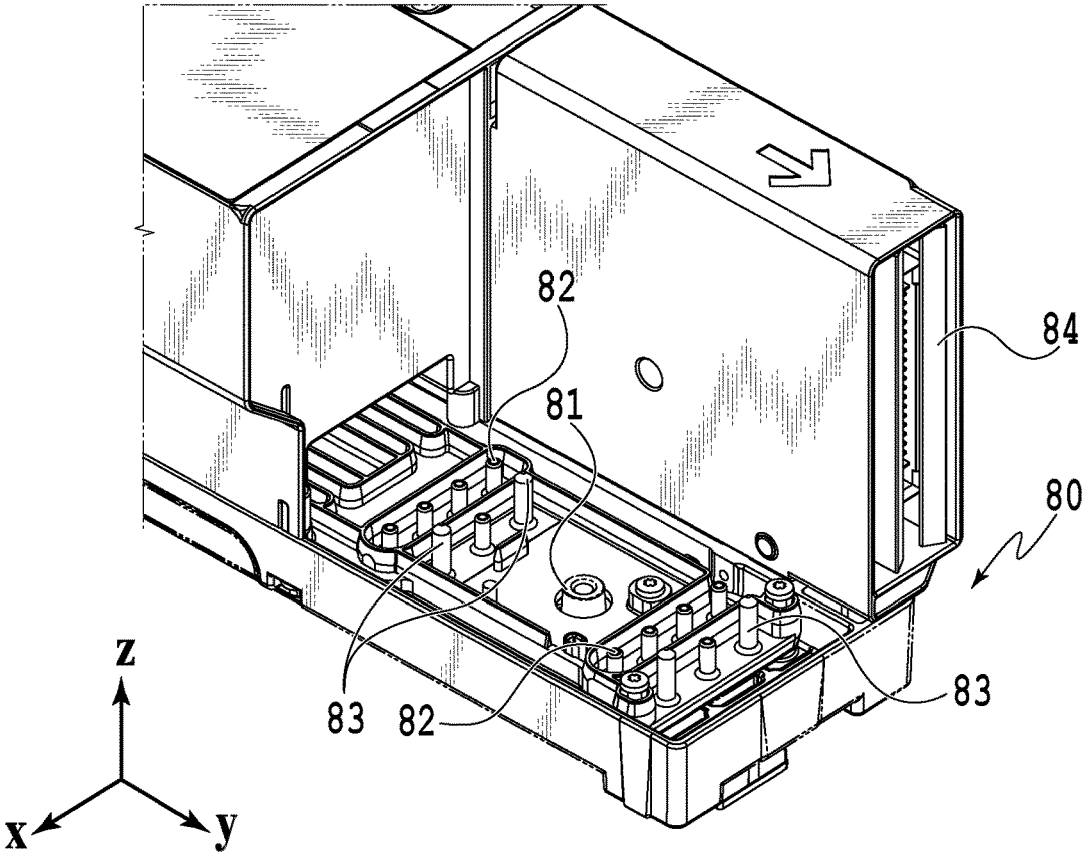

FIGS. 10A and 10B are views showing the connection between the print head 80 and the joint unit 30. FIG. 10A shows the joint unit 30 whereas FIG. 10B shows a connection region of the print head 80 to be connected to the joint unit 30. The connection region of the print head 80 is located at the reverse of a surface at which an ejection opening surface 8*a* is formed and on the far side in the insertion direction (in the +y direction) in the print head 80.

The joint unit 30 includes a supply joint portion 32 for supplying ink to the print head 80 and a collection joint portion 33 for collecting ink from the print head 80. The joint unit 30 is fixed to a holder plate 31 (see FIG. 11) serving as a supporter. At substantially the center of the holder plate 31 is formed a hole 31*a*, through which a shaft for use in connecting to the print head 80 is inserted.

In the meantime, the print head 80 includes head joints for supplying and receiving ink (hereinafter referred to as needles 82) and positioning pins 83, as shown in FIG. 10B. Both of the needles 82 to be connected to the supply joint portion 32 and the needles 82 to be connected to the collection joint portion 33 are provided for four colors, that is, cyan, magenta, yellow, and black. Moreover, the two positioning pins 83 are provided for each of the supply joint portion 32 and the collection joint portion 33.

At a connection surface of the joint unit 30, connected to the print head 80, a needle joint 34 is arranged at a position corresponding to the needle 82, and furthermore, a pin guide 35 is arranged at a position corresponding to the positioning pin 83. The eight needles 82 are connected to the eight needle joints 34, respectively, under the guidance of the insertion of the positioning pins 83 into the pin guides 35, thus achieving the connection between the printing apparatus 1 (the ink supplying unit 15) and the print head 80. In this manner, the connection direction (i.e., the z direction) between the print head 80 and the joint unit 30 is designed to cross a direction in which the print head 80 is mounted on the printing apparatus 1 (i.e., the y direction). Here, although FIG. 10A shows a state in which a tube 39 is connected to each of the supply joint portion 32 and the collection joint portion 33, the tube 39 is omitted in the other figures for the sake of convenience.

Figure 11:
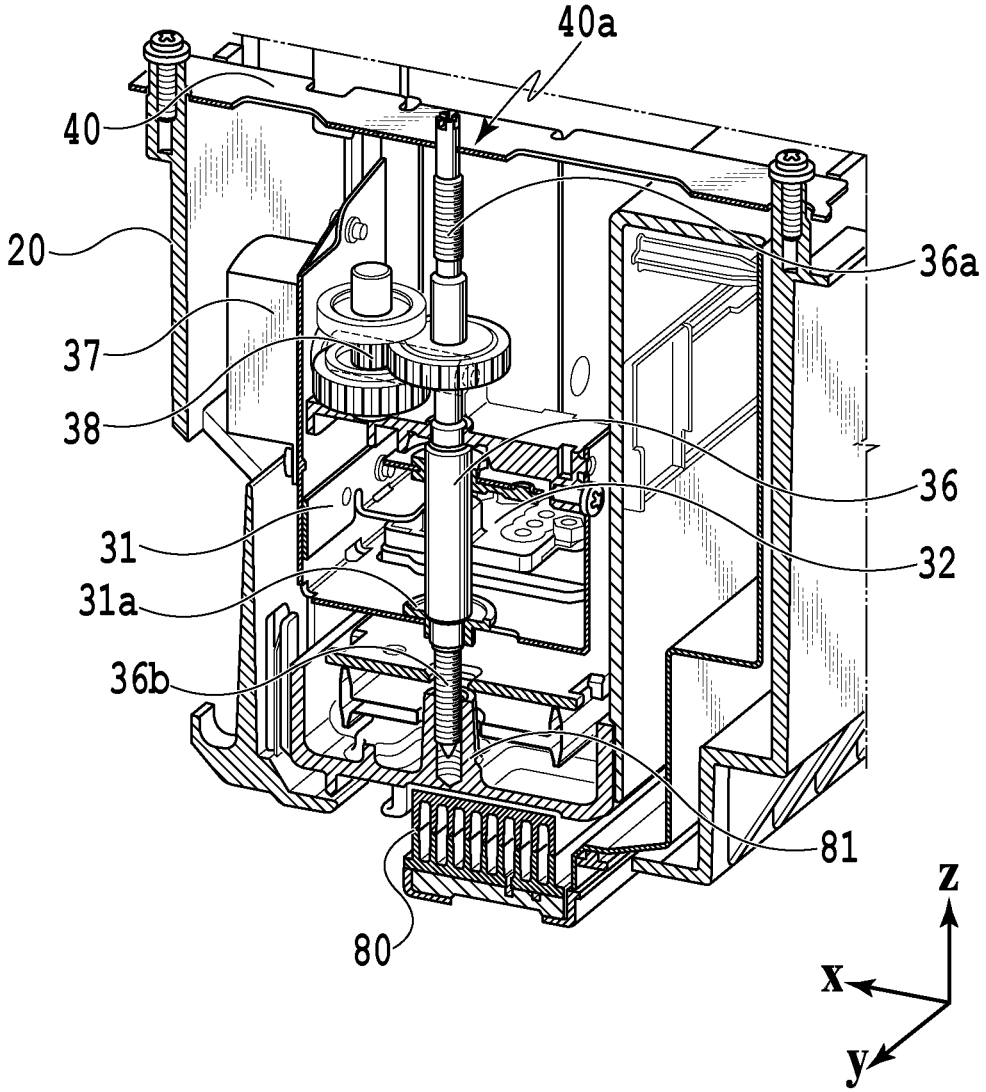
FIG. 11 is a view showing the print head and the joint unit at the head holder.

FIG. 11 is a cross-sectional view showing a state in which the print head 80 and the joint unit 30 are connected to each other in the head holder 20. The holder plate 31 rotatably supports a screw shaft 36 which penetrates the hole 31*a* formed at substantially the center thereof. The screw shaft 36 includes a first screw portion 36*a* formed at the upper part thereof and a second screw portion 36*b* formed at the lower part thereof. The first screw portion 36*a* can be engaged with a nut hole 40*a* formed at a lift plate 40 whereas the second screw portion 36*b* can be engaged with a head nut 81 serving as an engaging portion on the side of the print head 80. FIG.

11 shows a state in which the first screw portion 36*a* is not engaged with the nut hole 40*a* whereas the second screw portion 36*b* is engaged with the head nut 81.

On the holder plate 31, an elevating motor 37 serving as a drive source and a gear train 38 for transmitting the drive force of the elevating motor 37 to the screw shaft 36 are mounted in addition to the above-described supply joint portion 32 and collection joint portion 33. The elevating motor 37 is controlled by the head carriage control unit 208 according to the instructions of the print controller 202 illustrated in FIG. 2. In other words, the head carriage control unit 208 switches the rotational direction of the elevating motor 37, thus enabling the entire joint unit 30 to ascend and descend in the axial direction of the screw shaft 36 so as to control the connection and separation between the print head 80 and the joint unit 30.

Figure 12A:
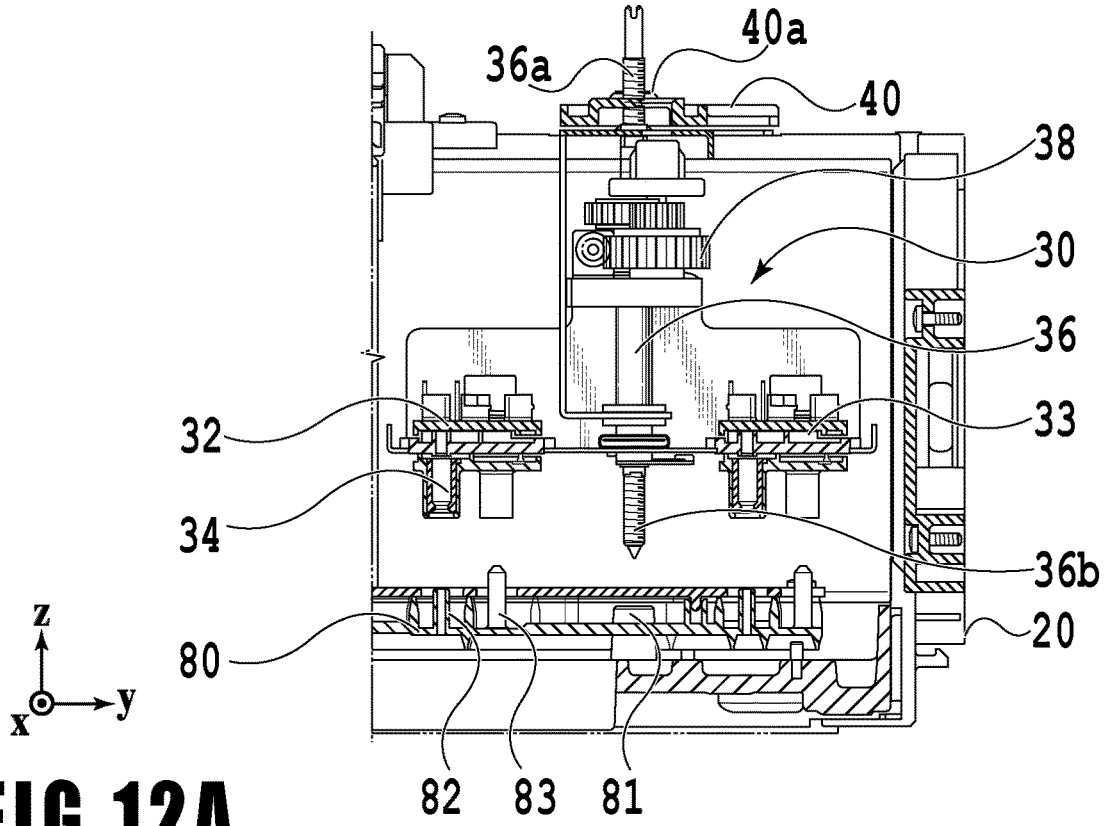
FIGS. 12A and 12B are views showing the ascent and descent of the joint unit.
Figure 12B:
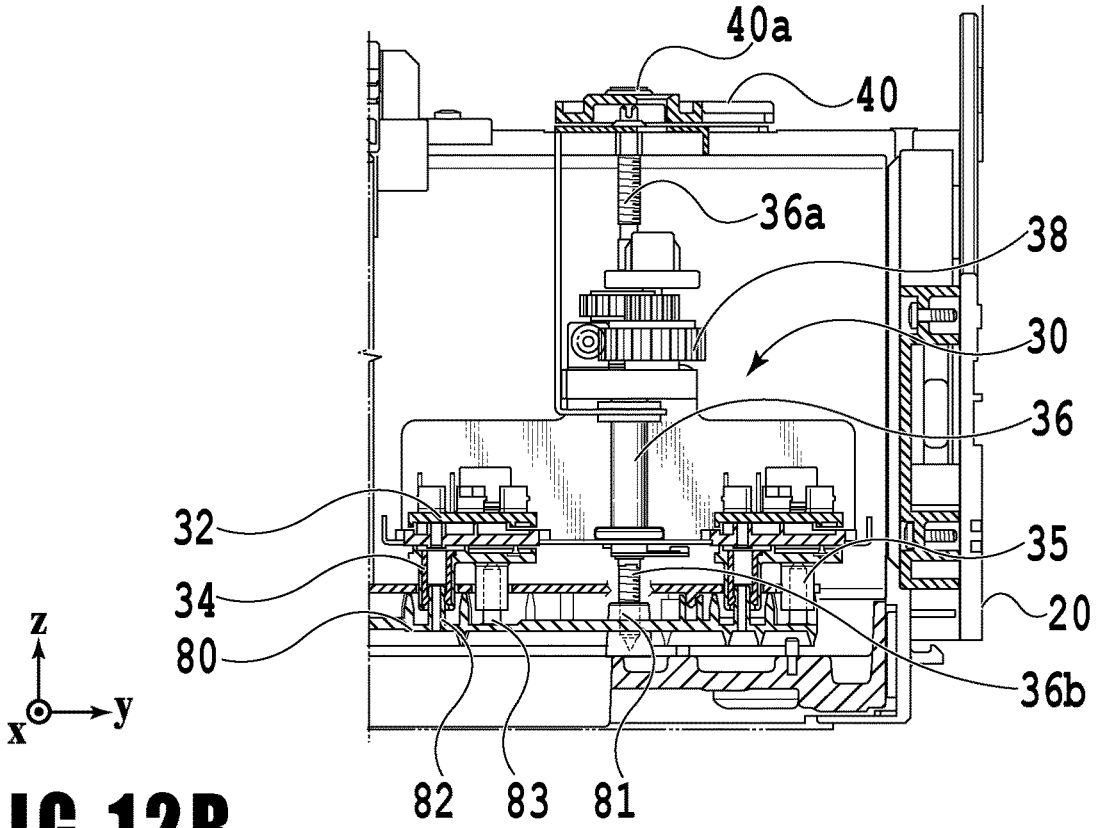

FIGS. 12A and 12B are views showing the ascent and descent of the joint unit 30 in the head holder 20, wherein FIG. 12A shows a state in which the joint unit 30 is separated from the print head 80 and FIG. 12B shows a state in which the joint unit 30 is connected to the print head 80.

In the separated state shown in FIG. 12A, the screw shaft 36 is held above, and its upper end projects from the lift plate 40. The first screw portion 36*a* is engaged with the nut hole 40*a* formed at the lift plate 40. The second screw portion 36*b* is separated from the head nut 81. As a consequence, the respective needle joints 34 of the supply joint portion 32 and the collection joint portion 33 are separated from the needles 82 of the print head 80, so that the print head 80 is not connected to the printing apparatus 1. In the present embodiment, a user attaches or detaches the print head 80 to or from the head holder 20 in the separated state.

In the connected state shown in FIG. 12B, the screw shaft 36 is held below, and the first screw portion 36*a* is withdrawn downward of the lift plate 40. In other words, the first screw portion 36*a* is not engaged with the nut hole 40*a* formed at the lift plate 40 whereas only the second screw portion 36*b* intrudes and is engaged with the head nut 81. At this time, the needle joints 34 are joined with the needles 82 of the print head 80, thus connecting the print head 80 to the printing apparatus 1.

In the present embodiment, the elevating motor 37 automatically switches the above-described separated state and connected state. Consequently, the connection and separation between the print head 80 and the printing apparatus 1 can be smoothly achieved without giving any trouble to a user, unlike in the conventional arrangement.

In transiting from the separated state to the connected state, the print controller 202 confirms the energization between the electric connected portion 84 on the head side and the electric connected portion 23 on the holder side, and then, performs the transition. Here, if an electric contact is adversely influenced by static electricity or the like, the print controller 202 may erroneously detect that the print head 80 is mounted, although no print head 80 is mounted. In this state, if the joint unit 30 descends, the screw shaft 36 falls on the bottom of the head holder 20 at a timing at which the first screw portion 36*a* is withdrawn from the nut hole 40*a*, thereby incurring the risk of breakage of the head holder.

Alternatively, if ink is started to be supplied from the supply joint portion 32 in the state of the erroneous detection that the print head 80 is mounted, the supplied ink contaminates the inside of the apparatus. In particular, in an inkjet printing apparatus of a full line type, ink may be supplied under pressure in order to stably supply the ink to a print head having ejection openings arrayed in a high density. The printing apparatus 1 in the present embodiment also adopts a mode in which a pump, not shown, supplies the ink under pressure from a sub-tank disposed in the ink supplying unit 15 to the print head 80. This induces a greater concern of leakage or contamination of the ink than in a supply mode utilizing an ink head difference.

More specifically, in consideration of an adverse effect by static electricity or the like, it is not favorable from the viewpoint of reliability to securely determine based on only the energization whether or not the print head 80 is actually mounted. In view of this, in the present embodiment, a sensor is additionally prepared for detecting positions above and below the joint unit 30, so as to controllably prevent the ascent and descent of the joint unit 30 more than necessary.

FIGS. 13A to 13D are views stepwise explanatory of the relationship between the position of the joint unit 30 and the detection position of the sensor inside of the head holder 20. A lift flag 31*b* having a predetermined width in a vertical direction is fixed to the side surface of the holder plate 31 in such a manner as to project outside of the holder plate 31. As a consequence, the lift flag 31*b* can be moved in the vertical direction together with the holder plate 31 according to the rotation of the screw shaft 36. In the meantime, a first sensor 21 and a second sensor 22 are arranged with a predetermined interval in the vertical direction inside of the head holder 20 and on the way of a path on which the lift flag 31*b* passes.

Each of the first sensor 21 and the second sensor 22 is an optical sensor including a light emitter and a light receiver. When the lift flag 31*b* is positioned apart from the sensors, a light beam emitted from the light emitter is received by the light receiver. When the lift flag 31*b* is located at a position corresponding to the sensor, a light beam emitted from the light emitter is shut out by the lift flag 31*b*, and therefore, is not received by the light receiver. The head carriage control unit 208 determines the vertical positions of the joint unit 30 based on the combination of whether or not the first sensor receives a light beam (Open/Close) and whether or not the second sensor receives a light beam (Open/Close).

A lift plate cover 41 for covering the lift plate 40 is placed on the farther upper surface of the lift plate 40, and is screwed to the head holder 20. Here, the lift plate 40 and the lift plate cover 41 are not fixed to each other. The lift plate 40 can be slightly moved in both of the xy directions and the z direction with respect to the head holder 20. A slight gap G is defined between the lift plate 40 and the lift plate cover 41 in a normal state (see FIG. 14A).

Figure 13A:
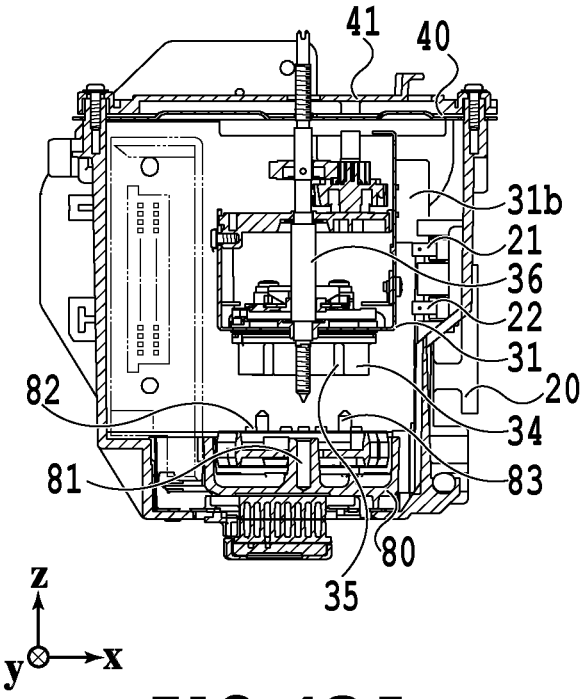
FIGS. 13A to 13D are views showing positions of the joint unit and detection positions of sensors.

FIG. 13A shows a separated state similar to that shown in FIG. 12A. The lower end of the screw shaft 36 is located above and apart from the head nut 81, and furthermore, the needle joints 34 and the pin guides 35 are separated from the needles 82 and the positioning pins 83 at the print head 80, respectively. The lift flag 31*b* is located above the first sensor 21. The detection results of both of the first sensor 21 and the second sensor 22 are Open (not-shut-out).

When the head carriage control unit 208 drives the elevating motor 37 forward, the screw shaft 36 descends while its first screw portion 36*a* is engaged with the nut hole 40*a*, and accordingly, the entire joint unit 30 gradually descends. With continuation of this descent for a while, the second screw portion 36*b* of the screw shaft 36 intrudes into the head nut 81 soon.

When the second screw portion 36*b* is engaged with the head nut 81, the screw shaft 36 comes to be engaged with both of the lift plate 40 and the print head 80. The second screw portion 36*b* is engaged with the head nut 81 while positioning within an xy plane and receives upward drag from the head nut 81 until the phase of the screw connection of the first screw portion 36*a* to the nut hole 40*a* matches the phase of the screw connection of the second screw portion 36*b* to the head nut 81. Since the screw shaft 36 receives this upward drag, force acts to lift the lift plate 40.

Figure 14A:
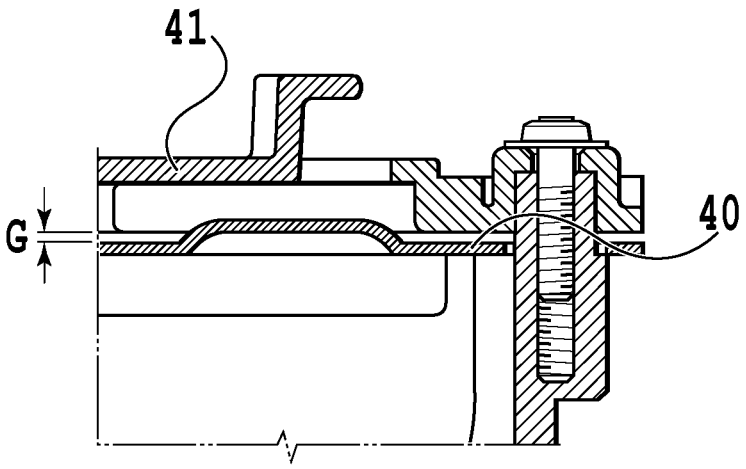
FIGS. 14A and 14B are enlarged views showing a lift plate and a lift plate cover.
Figure 14B:
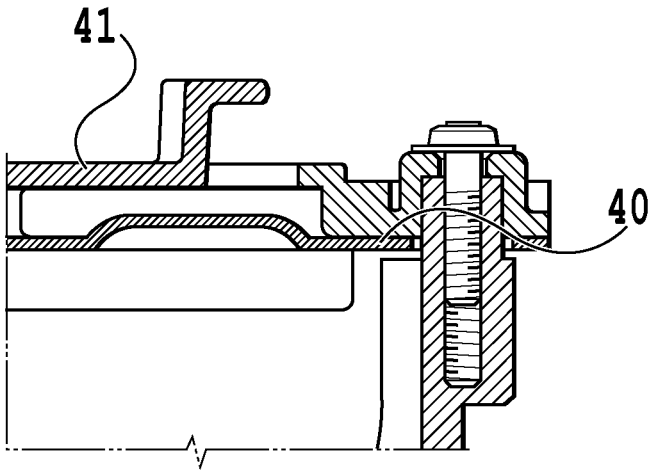

FIGS. 14A and 14B are enlarged views explanatory of the above-described state in detail. In the normal state, the gap G shown in FIG. 14A is defined between the lift plate 40 and the lift plate cover 41. On the other hand, in a case where the screw shaft 36 receives the drag from the head nut 81, the lift plate 40 is lifted, thereby narrowing the gap G. The lift plate 40 may be brought into contact with the lift plate cover 41, as shown in FIG. 14B. In this manner, defining the gap G between the lift plate 40 and the lift plate cover 41 can suppress any accidental application of the drag applied from the head nut 81 to other members.

Thereafter, when the phase of the screw connection between the second screw portion 36*b* and the head nut 81 matches with the phase of the screw connection between the first screw portion 36*a* and the nut hole 40*a*, the screw shaft 36 starts to descend again. At this time, since the screw shaft 36 does not receive any drag from the head nut 81, the lift plate 40 returns to the position shown in FIG. 14A. Moreover, when the screw shaft 36 further descends, the first screw portion 36*a* is withdrawn downward of the nut hole 40*a*, thus releasing the first screw portion 36*a* and the nut hole 40*a* from being engaged with each other. More specifically, the screw shaft 36 is released from being engaged with the lift plate 40, and thus, is engaged only with the print head 80.

As described above, the first screw portion 36*a* and the second screw portion 36*b* are disposed at the screw shaft 36 in the positional relationship of separation of a predetermined distance so as to enable the screw shaft 36 to be engaged with both of the lift plate 40 and the print head 80. In this way, the state in which the joint unit 30 is engaged with the head holder 20 can be smoothly changed to the state in which it is engaged with the print head 80. Here, the size of the gap G is previously determined in such a manner as to correspond to a region (i.e., a length) in which the screw shaft 36 can be engaged with both of the lift plate 40 and the print head 80.

Incidentally, also when the joint unit 30 is separated from the print head 80, the screw shaft 36 receives the drag from the head nut 81. More specifically, the screw shaft 36 receives the drag from the head nut 81 so as to lift the lift plate 40 until the phase of the screw connection between the first screw portion 36*a* and the nut hole 40*a* matches the phase of the screw connection between the second screw portion 36*b* and the head nut 81. At any rate, previously defining the gap G having a proper size between the lift plate 40 and the lift plate cover 41 enables the joint unit 30 to smoothly ascend and descend.

As described already, the lift plate 40 has a region in which it can move also in the xy directions with respect to the head holder 20. As a consequence, the entire joint unit 30 can move according to positioning the screw shaft 36 that ascends and descends.

Figure 13B:
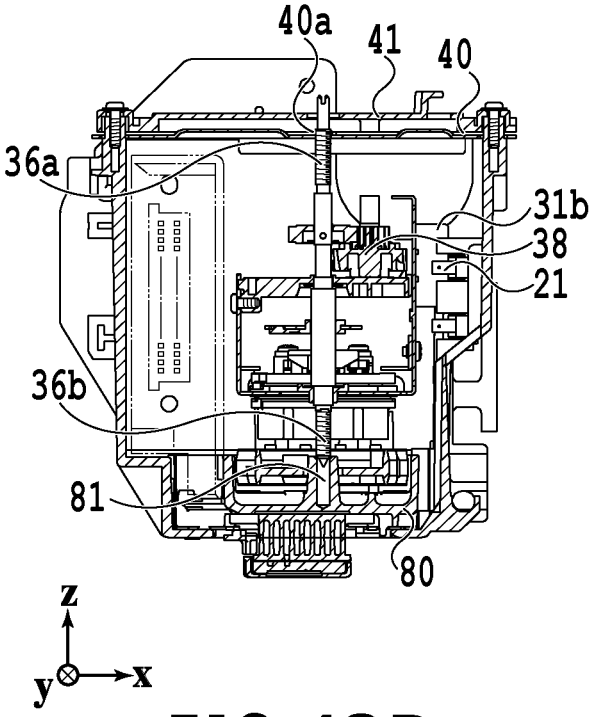

Returning to FIGS. 13A to 13D, the description will be continued below. FIG. 13B shows a state in which the joint unit 30 further descends so that the lower end of the lift flag 31*b* shuts out the first sensor 21. At this time, the detection value of the first sensor 21 indicates Close (shut-out) whereas the detection value of the second sensor 22 indicates Open (not-shut-out). The second screw portion 36*b* of the screw shaft 36 is engaged with the head nut 81, and furthermore, the first screw portion 36*a* is engaged with the nut hole 40*a* of the lift plate 40.

Figure 13C:
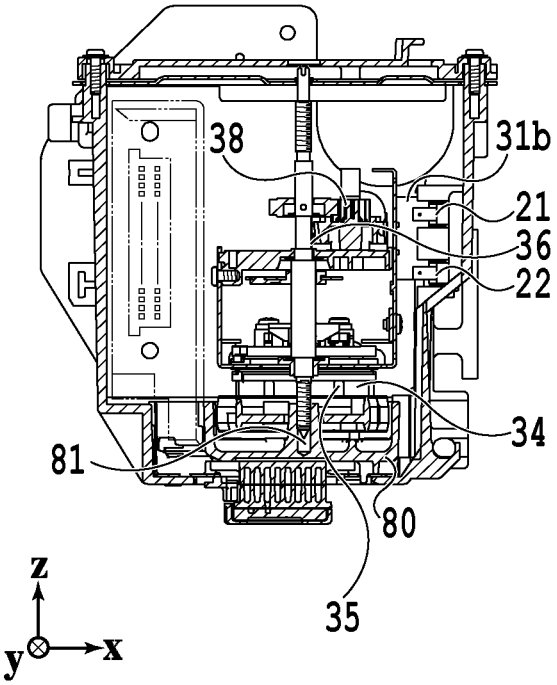

FIG. 13C shows a state in which the joint unit 30 further descends so that both of the first sensor 21 and the second sensor 22 are shut out by the lift flag 31*b*. From the state shown in FIG. 13B to the state shown in FIG. 13C, the positioning pins 83 of the print head 80 gradually intrude into the pin guides 35 of the joint unit 30, and furthermore, the needles 82 of the print head 80 gradually intrude into the needle joints 34 of the joint unit 30. In the state shown in FIG. 13C, the positioning pins 83 are completely connected to the pin guides 35, and furthermore, the needles 82 are completely connected to the needle joints 34.

At this time, both of the detection values of the first sensor 21 and the second sensor 22 indicate Close (shut-out). The print controller 202 can determine based on the detection values of these sensors that the print head 80 is connected to the printing apparatus 1.

Figure 13D:
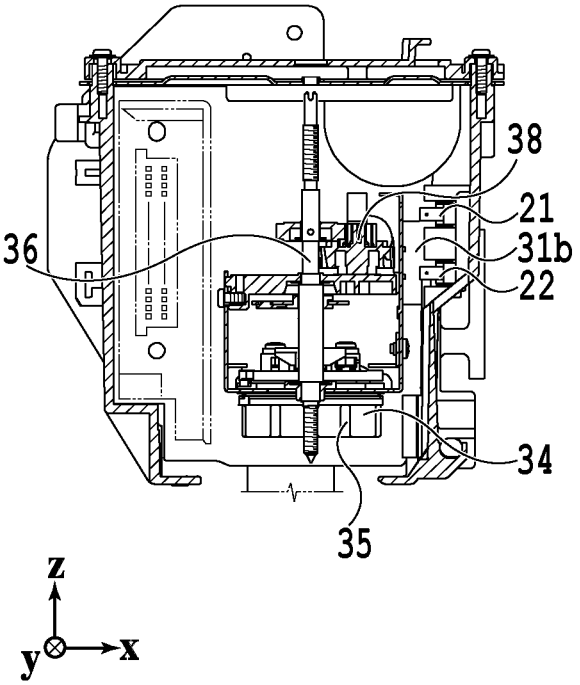

FIG. 13D shows a state in which the joint unit 30 descends and runs over when the print head 80 is not held in the head holder 20. Since the upper end of the lift flag 31*b* passes the first sensor 21, the detection value of the first sensor 21 results in Open (non-shut-out). In other words, the print controller 202 can presume based on the detection results of these sensors that the print head 80 is not normally held in the head holder 20.

FIG. 15 is a table illustrating the relative positions of the joint unit 30 to the print head 80, the respective engaged states of the screw shaft 36 corresponding to the positions and the respective detection results of the sensors corresponding to the positions. The print controller 202 can determine the position of the joint unit 30 or the connected state between the print head 80 and the joint unit 30 based on the combinations of the detection results of the first sensor 21 and the second sensor 22. Moreover, in the case where the detection value of the first sensor 21 is Open whereas the detection value of the second sensor 22 is Close, the print controller 202 can presume that the print head 80 is not normally disposed.

Figure 16:
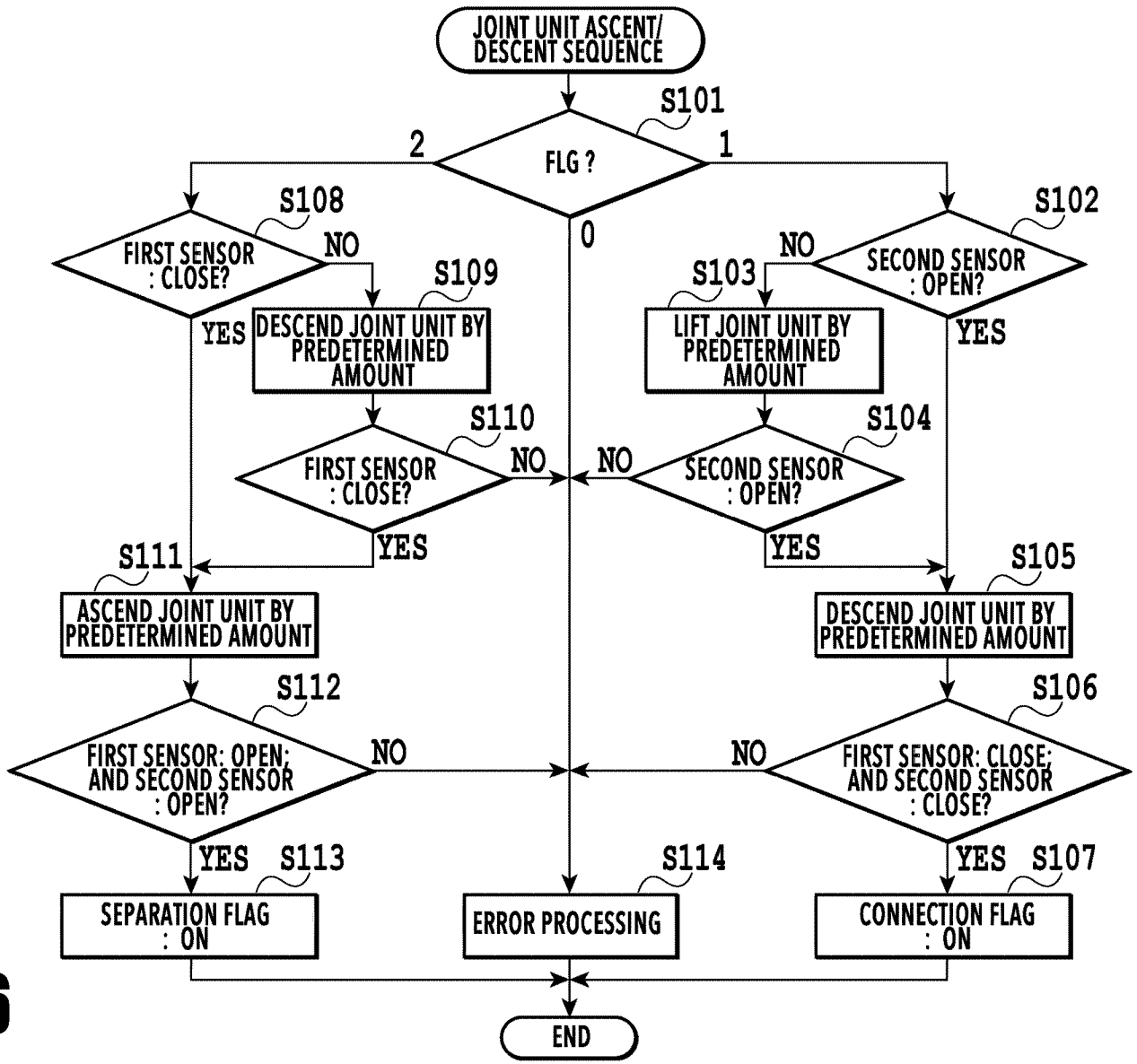
FIG. 16 is a flowchart illustrating an ascent/descent sequence of the joint unit.

FIG. 16 is a flowchart illustrating an ascent/descent sequence of the joint unit 30, which is executed by the print controller 202 while using the head carriage control unit 208. This processing is started based on an instruction of a user or the determination of the print controller 202 in the case where the print head 80 and the joint unit 30 need to be connected to or separated from each other, like the replacement of the print head 80.

Upon the start of this processing, the print controller 202 first confirms a value of a joint flag (FLG) in S101. The joint flag is adapted to designate the tendency of the connection between the joint unit 30 and the print head 80. FLG=1 when a connecting operation is performed; and FLG=2 when a separating operation is performed. FLG=0 when neither the connecting operation nor the separating operation is performed. For example, FLG=0 when the printing apparatus 1 is shipped.

In the case where FLG=1 in S101, the print controller 202 proceeds to S102 in order to perform an operation for connecting the joint unit 30 and the print head 80 to each other. In the case where FLG=2, the print controller 202 proceeds to S108 in order to perform an operation for separating the joint unit 30 and the print head 80 from each other. In the case where FLG=0, the print controller 202 determines that the joint unit 30 does not need to ascend or descend, performs a predetermined error processing in S114, and ends this processing.

In connecting the joint unit 30 and the print head 80 to each other, the print controller 202 confirms the detection result of the second sensor 22 in S102. When the detection result of the second sensor 22 indicates Open, the print controller 202 determines that the joint unit 30 can descend in the current state, and then, it proceeds to S105.

On the other hand, when the detection result of the second sensor 22 indicates Close in S102, although FLG=1 in S101 (i.e., a connecting operation is designated), there is apprehension that the previous operation is not normally performed, like a power is cut off during the previous connecting or separating operation. In view of this, the print controller 202 ascends the joint unit 30 once in order to reset the state. More specifically, the print controller 202 proceeds to S103, and then, reversely rotates the elevating motor 37 so as to ascend the joint unit 30 by a predetermined amount. Thereafter, when the print controller 202 confirms that the detection result of the second sensor 22 indicates Open in S104, the print controller 202 proceeds to S105 in order to descend the joint unit 30.

In S105, the print controller 202 rotates the elevating motor 37 forward so as to descend the joint unit 30 by a predetermined amount. In S106, when the print controller 202 confirms that both of the detection results of the first sensor 21 and the second sensor 22 indicate Close, it proceeds to S107, and then, sets a connection flag indicating that the print head 80 and the joint unit 30 are connected to each other.

On the other hand, in the case where the detection result of the second sensor 22 in S104 indicates Close and where at least either one of the detection results of the first sensor 21 and the second sensor 22 in S106 indicates Open, this means that the joint unit 30 does not normally ascend or descend. Thus, the print controller 202 performs the predetermined error processing in S114, and then, ends this processing.

Next, explanation will be made on the separating operation when it is confirmed in S101 that FLG=2. In the separating operation, the head carriage control unit 208 confirms the detection result of the first sensor 21 in S108. In the case where the detection result of the first sensor 21 indicates Close, the print controller 202 determines based on the current state that the joint unit 30 can ascend, and then, proceeds to S111.

On the other hand, there is apprehension that the previous connecting or separating operation is not normally performed or the screw shaft 36 falls in the case where the detection result of the first sensor 21 indicates Open in S108, although FLG=2 (i.e., the separating operation is designated). In view of this, the print controller 202 descends the joint unit 30 once in order to reset the state. More specifically, the head carriage control unit 208 rotates the elevating motor 37 forward in S109 so as to descend the joint unit 30 by a predetermined amount. Thereafter, when the print controller 202 confirms that the detection result of the first sensor 21 in S110 indicates Close, the print controller 202 proceeds to S111 in order to ascend the joint unit 30.

In S111, the print controller 202 reversely rotates the elevating motor 37 so as to ascend the joint unit 30 by a predetermined amount. In S112, when the print controller 202 confirms that both of the detection results of the first sensor 21 and the second sensor 22 indicate Open, it sets a separation flag indicating that the print head 80 and the joint unit 30 are separated from each other.

In contrast, in the case where the detection result of the first sensor 21 in S110 indicates Open and where at least either one of the detection results of the first sensor 21 and the second sensor 22 in S112 indicates Close, this means that the joint unit 30 does not normally ascend or descend. Thus, the print controller 202 performs the predetermined error processing in S114, and then, ends this processing.

As described above, the print controller 202 in the present embodiment controls the rotational direction and rotational amount of the elevating motor 37 while confirming the detection results of the first sensor 21 and the second sensor 22. Thus, the connection and separation between the print head 80 and the joint unit 30 can be securely achieved without giving any trouble to a user.

Figure 17:
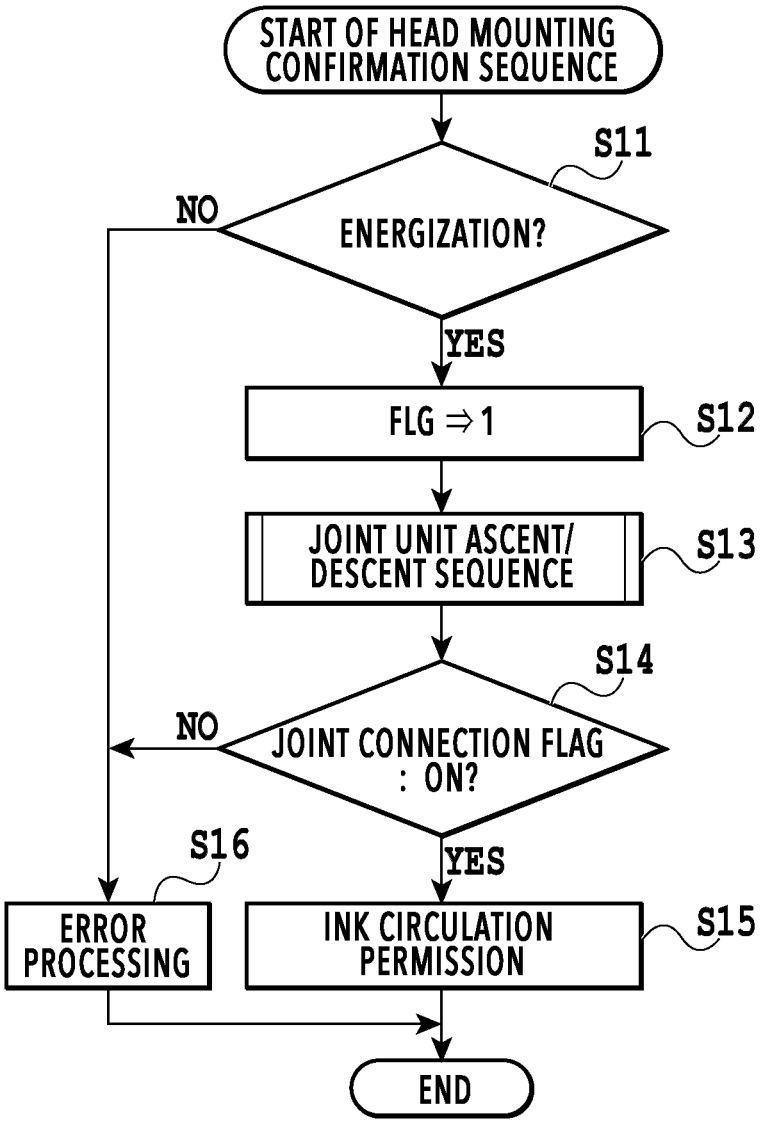
FIG. 17 is a flowchart illustrating a print head mounting confirmation sequence.

FIG. 17 is a flowchart illustrating a print head mounting confirmation sequence to be executed by the print controller 202 after a user holds the print head 80 in the head holder 20. This processing is started in response to an instruction of a user or the determination of the print controller 202 after the user disposes the print head 80 in the head holder 20 in accordance with the procedures illustrated in FIGS. 9A and 9B.

Upon the start of this processing, the print controller 202 confirms the energization between the electric connected portion 23 on the holder side and the electric connected portion 84 on the head side via the head carriage control unit 208 in S11. In the case of the energization, the print controller 202 determines that the print head 80 is electrically connected to the printing apparatus 1, and then, proceeds to S12.

The print controller 202 sets the joint flag to 1 (FLG=1) in S12, and then, executes the joint unit ascent/descent sequence that has been described with reference to FIG. 16 in the subsequent step S13. Since the joint flag is set to 1, the print controller 202 proceeds to S102 in the joint unit ascent/descent sequence illustrated in FIG. 16, and then, the connection flag is set in S107 in the case where the connecting operation is normally performed in a fluid manner.

Upon completion of the joint unit ascent/descent sequence, the print controller 202 proceeds to S14, in which it is confirmed whether or not the connection flag (S107) is set. In the case where the connection flag is confirmed, the print head 80 and the printing apparatus 1 are regarded as being both electrically and mechanically connected to each other. Thus, the print controller 202 proceeds to S15, and then, allows ink to be circulated in the print head 80. More specifically, the print controller 202 allows ink to be supplied from the ink supplying unit 15 to the print head 80 and the ink to be collected from the print head 80 toward the ink supplying unit 15.

In contrast, in the case where the energization is not confirmed in S11 or where the connection flag is not confirmed in S14, the print controller 202 proceeds to S16, and then, performs a predetermined error processing, like notifying a user that the print head 80 cannot be successfully mounted. In this manner, the present processing comes to an end.

Figure 18:
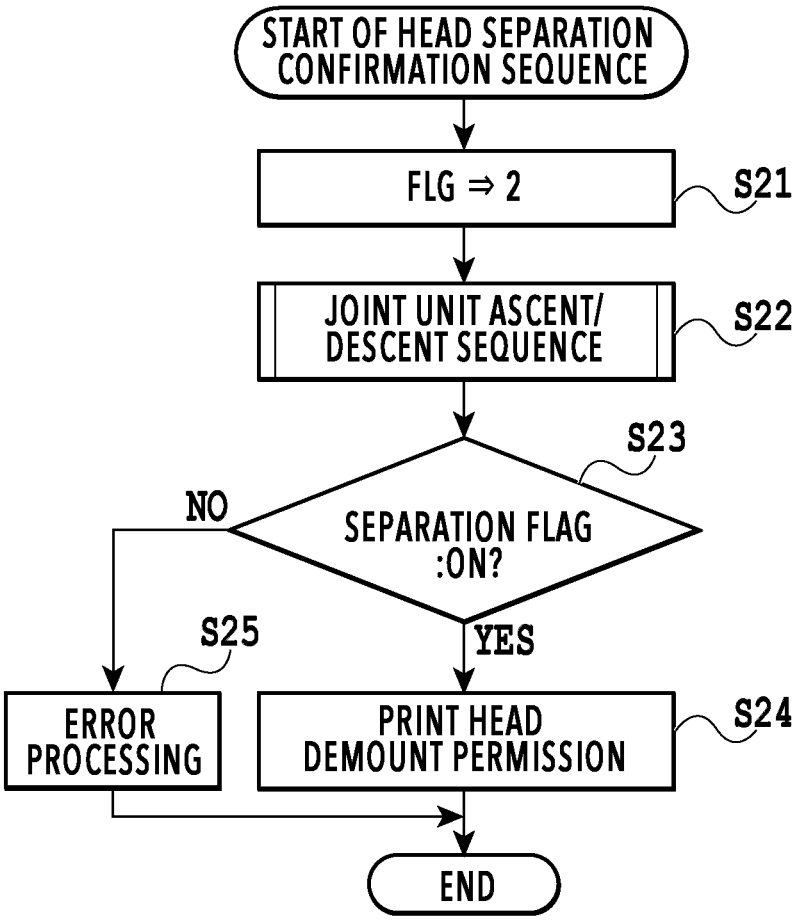
FIG. 18 is a flowchart illustrating a head demounting confirmation sequence.

FIG. 18 is a flowchart illustrating a head separation confirmation sequence to be executed by the print controller 202. This processing is started in response to an instruction of a user or the determination by the print controller 202 in the case where the print head 80 currently being mounted is demounted from the printing apparatus 1.

Upon the start of this processing, the print controller 202 sets the joint flag to 2 (FLG=2) in S21. Subsequently, the print controller 202 proceeds to S22, and then, it executes the joint unit ascent/descent sequence described with reference to FIG. 16. Since the joint flag is set to 2, the print controller 202 proceeds to S108 in the joint unit ascent/descent sequence illustrated in FIG. 16. In the case where the separating operation is normally performed, the print controller 202 sets the separation flag in S113.

Upon completion of the joint unit ascent/descent sequence, the print controller 202 proceeds to S23, and then, it confirms whether or not the separation flag is set (S113). In the case where the separation flag is confirmed, the print controller 202 performs a predetermined processing for allowing the print head to be demounted in S24, and then, ends this processing.

In contrast, in the case where the separation flag is not confirmed in S23, the print controller 202 proceeds to S25, and then, performs a predetermined error processing for notifying a user that the print head 80 cannot be successfully disconnected. Thus, the present processing comes to an end.

As described above, in the present embodiment, the connection and separation between the printing apparatus and the print head can be performed securely without placing a burden on a user.

Incidentally, although the inkjet printing apparatus using an ink supply system of a circulation type has been exemplified above, the present invention is not limited to this. Since a printing apparatus is simply required to be provided with a joint unit for supplying ink from an ink tank to a print head, it is not essential to collect ink from a print head.

Moreover, although the description has been given of the mode in which the joint unit 30 is vertically connected from above to the print head 80 held in the head holder 20, the present invention is not limited to this. For example, a joint unit 30 may be horizontally connected to a print head 80.

In this case, a screw shaft 36 is horizontally moved, and a first sensor and a second sensor are horizontally juxtaposed with each other. Additionally, since no gravity acts in an advance direction of a screw shaft, it is preferable that a spring unit or the like for urging a lift holder toward a print head should be prepared.

In addition, although the explanation has been made on the color inkjet print head of a full line type, the present invention is not limited to this. A print head may be of a serial type. Alternatively, a print head may be a monochromatic head that uses only black ink or may be a head capable of ejecting various kinds of ink such as light cyan ink and light magenta ink.

At any rate, an inkjet printing apparatus capable of having a print head mounted thereon independently of an ink tank requires the connection between the print head and the printing apparatus every time the print head is mounted, and therefore, the present invention can effectively function.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-065236 filed Mar. 29, 2018, which is hereby incorporated by reference herein in its entirety.

What is claimed is:

1. A printing apparatus comprising:

a head unit including a print head configured to eject liquid;

a tank configured to reserve liquid to be supplied to the print head; and a connecting unit configured to connect the print head and the tank to each other, wherein the connecting unit includes (a) a connecting portion for supplying liquid to the print head and (b) a shaft movable in an axial direction of the shaft and rotatable around the axial direction, and wherein the head unit includes a head joint connectable to the connecting portion.

2. The printing apparatus according to claim 1, wherein the connecting portion and the head joint are connectable to each other in the axial direction.

3. The printing apparatus according to claim 1, wherein the liquid can be supplied to the print head in a case where the connecting portion and the head joint are connected to each other.

4. The printing apparatus according to claim 1, wherein the connecting unit further includes a drive source that moves the shaft in the axial direction and rotates around the axial direction.

5. The printing apparatus according to claim 4, wherein the shaft is rotated around the axial direction thereof by the drive source.

6. The printing apparatus according to claim 1, wherein the connecting unit further includes a second connecting portion for collecting liquid from the print head, and wherein the head unit further includes a second head joint connectable to the second connecting portion.

7. The printing apparatus according to claim 6, wherein the second connecting portion and the second head joint are connectable to each other in the axial direction.

8. The printing apparatus according to claim 6, wherein the liquid can be collected from the print head in a case where the second connecting portion and the second head joint are connected to each other.

9. The printing apparatus according to claim 1, wherein the axial direction is parallel to a direction of gravity.

10. The printing apparatus according to claim 1, wherein the print head is a line head in which ejection openings to eject liquid are provided in an area corresponding to a width of a print medium.

11. A printing apparatus comprising:

a head unit including a print head configured to eject liquid;

a tank configured to reserve liquid to be supplied to the print head; and a connecting unit for connecting the print head and the tank, the connecting unit including a first connecting portion for supplying liquid to the print head, a second connecting portion for collecting liquid from the print head, and a shaft movable in an axial direction of the shaft and rotatable around the axial direction, wherein the head unit includes a first head joint connectable to the first connecting portion and a second head joint connectable to the second connecting portion.

12. The printing apparatus according to claim 11, further comprising:

a first tube for supplying liquid from the tank to the print head; and a second tube for collecting liquid from the print head, wherein the connecting unit is connected to both the first tube and the second tube.

13. The printing apparatus according to claim 11, wherein the shaft is moved and rotated by a drive source.

14. The printing apparatus according to claim 13, further comprising the drive source.

15. The printing apparatus according to claim 11, wherein the liquid is circulated between the print head and the tank.

16. The printing apparatus according to claim 11, wherein the print head is a line head in which ejection openings configured to eject liquid are provided corresponding to a width of a print medium.

17. A printing apparatus comprising:

a head unit including a print head configured to eject liquid;

a tank configured to reserve liquid to be supplied to the print head;

a connecting unit for connecting the print head and the tank, the connecting unit including a connecting portion for supplying liquid to the print head and a shaft movable in an axial direction of the shaft and rotatable around the axial direction, wherein the head unit includes a head joint connectable to the connecting portion, and wherein the liquid is circulated between the print head and the tank.

18. The printing apparatus according to claim 17, further comprising a tube for supplying liquid from the tank to the print head, wherein the connecting unit is connected to the tube.

19. The printing apparatus according to claim 17, wherein the shaft is moved and rotated by a drive source.

20. The printing apparatus according to claim 19, further comprising the drive source.

* * * * *